US007648225B2

(12) United States Patent
Ishimoto et al.

(10) Patent No.: US 7,648,225 B2
(45) Date of Patent: Jan. 19, 2010

(54) PRINTING METHOD, PRINTING SYSTEM AND STORAGE MEDIUM

(75) Inventors: Bunji Ishimoto, Nagano-ken (JP); Akito Sato, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 286 days.

(21) Appl. No.: 11/480,492

(22) Filed: Jul. 5, 2006

(65) Prior Publication Data

US 2007/0008364 A1 Jan. 11, 2007

(30) Foreign Application Priority Data

Jul. 5, 2005 (JP) ..... 2005-196309

(51) Int. Cl.
*B41J 2/145* (2006.01)

(52) U.S. Cl. ..... 347/41; 347/15; 347/9

(58) Field of Classification Search ..... 347/40, 347/41, 42, 12, 16, 9, 15
See application file for complete search history.

(56) References Cited

U.S. PATENT DOCUMENTS 6,390,598 B2 * 5/2002 Sato et al. ..... 347/41
2002/0039122 A1 * 4/2002 Chikuma et al. ..... 347/41

FOREIGN PATENT DOCUMENTS

JP 2002-11859 A 1/2002

* cited by examiner

*Primary Examiner*—Lam S Nguyen
(74) *Attorney, Agent, or Firm*—Sughrue Mion, PLLC

(57) ABSTRACT

A printing method includes: printing an image to be printed on a medium by repeating alternately a dot forming process for forming dots on the medium by ejecting ink from each nozzle of a plurality of nozzles, and a carrying process for carrying the medium in a carrying direction, and forming a plurality of rows of dots, lined up in the carrying direction, that are configured by a plurality of dots lined up in a movement direction; selecting a printing mode according to the number of the dots to be formed in a predetermined region of the medium, from among a plurality of the printing modes each with a different ratio of the number of dot rows formed using a different number of nozzles to the number of dot rows formed using a certain number of nozzles; and printing on the region to be printed based on the selected printing mode.

13 Claims, 25 Drawing Sheets

| NUMBER OF DOTS PER UNIT AREA | PRINTING METHOD | NUMBER OF POL NOZZLES |
|---|---|---|
| LARGE | GLOSSY BANDING SUPPRESSING PRINTING METHOD | 4 |
| STANDARD | STANDARD PRINTING METHOD | 6 |
| SMALL | DENSITY VARIATION BANDING SUPPERSSING PRINTING METHOD | 8 |

PRINTING METHOD OF THIS EMBODIMENT SELECTED ACCORDING TO THE NUMBER OF DOTS PER UNIT AREA

| | NUMBER OF DOTS PER UNIT AREA | | |
|---|---|---|---|
| | SMALL | STANDARD | LARGE |
| DEGREE OF CONSPICUOUSNESS OF DENSITY VARIATION BANDING | LARGE | MEDIUM | SMALL |
| DEGREE OF CONSPICUOUSNESS OF GLOSSY BANDING | SMALL | MEDIUM | LARGE |

DEGREE OF CONSPICUOUSNESS OF BANDING ACCORDING TO THE NUMBER OF DOTS PER UNIT AREA

FIG. 21

| NUMBER OF DOTS PER UNIT AREA | NUMBER OF POL NOZZLES |
|---|---|
| LARGE | GLOSSY BANDING LIKELY TO OCCUR, NUMBER OF POL NOZZLES DECREASED |
| SMALL | DENSITY VARIATION BANDING LIKELY TO OCCUR, NUMBER OF POL NOZZLES INCREASED |

NUMBER OF POL NOZZLES USED ACCORDING TO NUMBER OF DOTS PER UNIT AREA

FIG. 22

| NUMBER OF DOTS PER UNIT AREA | PRINTING METHOD | NUMBER OF POL NOZZLES |
|---|---|---|
| LARGE | GLOSSY BANDING SUPPRESSING PRINTING METHOD | 4 |
| STANDARD | STANDARD PRINTING METHOD | 6 |
| SMALL | DENSITY VARIATION BANDING SUPPERSSING PRINTING METHOD | 8 |

PRINTING METHOD OF THIS EMBODIMENT SELECTED ACCORDING TO THE NUMBER OF DOTS PER UNIT AREA

FIG. 24

PRINTING METHOD, PRINTING SYSTEM AND STORAGE MEDIUM

CROSS-REFERENCE TO RELATED APPLICATIONS

The present application claims priority upon Japanese Patent Application No. 2005-196309 filed on Jul. 5, 2005, which is herein incorporated by reference.

BACKGROUND

1. Technical Field

The present invention relates to printing methods, printing systems, and storage media.

2. Related Art

In printing apparatuses such as an inkjet printer, an image to be printed is printed on a medium by alternately repeating a dot forming process for forming dots by ejecting an ink from a nozzle moving in a movement direction, and a carrying process for carrying a medium such as paper in a carrying direction, and arranging continuously in the carrying direction raster lines that are configured by a plurality of the dots arranged in the movement direction.

As printing modes, there are known "interlace printing", "overlap printing", "non-uniform overlap printing" and the like (refer to JP-A-2002-11859). In the "non-uniform overlap printing", the number of nozzles used varies for each raster line. For example, the number of nozzles used for a certain raster line is two, but the number of nozzles used for a different raster line is three.

There is a case where a position of a dot formed by a nozzle is shifted in the carrying direction due to a manufacturing error of the nozzle. As a result, due to the shifting of the dot, there occurs a spacing in between the raster lines, and a stripe-shaped banding occurs. As a cause of banding in which this kind of variation in density occurs, there are other causes such as a carrying amount error or a curling of the printing medium.

With the non-uniform overlap printing, the banding due to variation in density can be suppressed in the raster line that has a large number of nozzles that are used for it. However, according to the non-uniform overlap printing, since there are mixed raster lines that have a different number of nozzles that are used for it, there is the case where banding caused by gloss occurs.

SUMMARY

An advantage of some aspects of the invention is that it is possible to suppress both the occurrence of banding caused by variation in density and the occurrence of banding caused by gloss.

An aspect of the invention is a printing method including: printing an image to be printed on a medium by repeating alternately a dot forming process for forming dots on the medium by ejecting ink from each nozzle of a plurality of nozzles, and a carrying process for carrying the medium in a carrying direction, and forming a plurality of rows of dots, lined up in the carrying direction, that are configured by a plurality of dots lined up in a movement direction; selecting a printing mode according to the number of the dots to be formed in a predetermined region of the medium, from among a plurality of the printing modes each with a different ratio of the number of dot rows formed using a different number of nozzles to the number of dot rows formed using a certain number of nozzles; and printing on the region to be printed based on the selected printing mode.

Another aspect of the invention is a printing system including: a carrying unit for carrying a medium in a carrying direction;

a carriage for moving each nozzle of a plurality of nozzles arranged in the carrying direction; and a controller that causes printing of an image to be printed on a medium by causing a printing apparatus to alternately repeat a dot forming process for forming dots on the medium by ejecting ink from each of the nozzles moving in a movement direction with the carriage, and a carrying process for carrying the medium in the carrying direction, and causing the printing apparatus to form a plurality of rows of dots, lined up in the carrying direction, that are configured by a plurality of dots lined up in the movement direction, the controller that causes printing with a printing mode with a predetermined ratio of a ratio of the number of the dot rows formed using a different number of the nozzles to the number of the dot rows formed using a certain number of nozzles, wherein the controller can select a plurality of the printing modes each with a different ratio, wherein the controller determines the printing mode at the time of printing the region, according to the number of the dots formed in a predetermined region of the medium.

Another aspect of the invention is a storage medium recorded with a driver for making a printer realize a function for printing an image to be printed on a medium by repeating alternately a dot forming process for forming dots on the medium by ejecting ink from each nozzle of a plurality of nozzles, and a carrying process for carrying the medium in a carrying direction, and forming a plurality of rows of dots, lined up in the carrying direction, that are configured by a plurality of dots lined up in a movement direction;

a function for selecting a printing mode according to the number of the dots to be formed in a predetermined region of the medium, from among a plurality of the printing modes, each with a different ratio of the number of dot rows formed using a different number of nozzles to the number of dot rows formed using a certain number of nozzles; and a function for printing on the region to be printed, based on the selected printing mode.

Other features of the invention will be made clear through the present specification with reference to the accompanying drawings.

BRIEF DESCRIPTION OF THE DRAWINGS

For a more, complete understanding of the invention and the advantages thereof, reference is now made to the following description taken in conjunction with the accompanying drawings wherein:

FIG. 21 is a diagram showing the degree of conspicuousness of density variation banding and glossy banding, according to the number of dots per unit area;

FIG. 22 is a diagram showing printing modes of this embodiment that are used according to the number of dots per unit area;

FIG. 24 is a diagram showing the printing modes according to this embodiment that are selected by the printer driver according to the number of dots per unit area;

DESCRIPTION OF EXEMPLARY EMBODIMENTS

Figure 1:
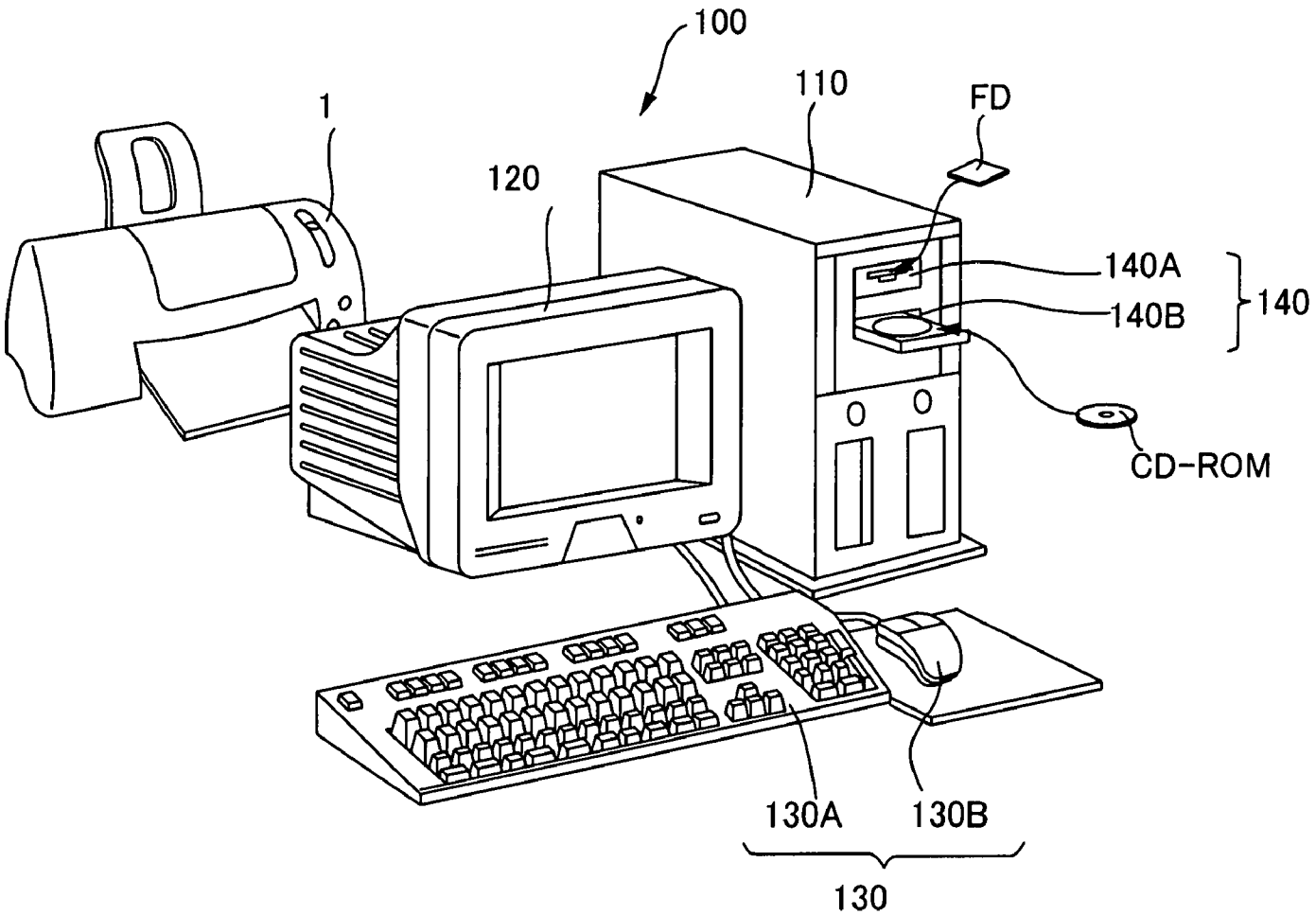
FIG. 1 is an explanatory diagram of an entire structure of a printing system.

At least the following matters will become clear through the description of the present specification and the accompanying drawings.

A printing method including:

printing an image to be printed on a medium by repeating alternately a dot forming process for forming dots on the medium by ejecting ink from each nozzle of a plurality of nozzles, and a carrying process for carrying the medium in a carrying direction, and forming a plurality of rows of dots, lined up in the carrying direction, that are configured by a plurality of dots lined up in a movement direction;

selecting a printing mode according to the number of the dots to be formed in a predetermined region of the medium, from among a plurality of the printing modes each with a different ratio of the number of dot rows formed using a different number of nozzles to the number of dot rows formed using a certain number of nozzles; and printing on the region to be printed based on the selected printing mode.

According to this printing method, the printing mode can be determined according to the number of the dots in the region, and the glossy banding and the density variation banding can be suppressed.

In this printing method, in the carrying process of each of a plurality of the printing modes, the medium is carried with a predetermined carrying amount in the carrying direction.

According to this printing method, each region of the print range can be printed with a different printing mode, and the glossy banding and the density variation banding of each region can be suppressed.

In this printing method, a print range of the medium is divided into a plurality of regions, and the predetermined region is one of the regions.

According to this printing method, the glossy banding and the density variation banding of each region of the print range that has been divided can be suppressed.

In this printing method, the print range is divided so as to arrange the divided regions along the movement direction.

According to this printing method, the printing mode that is appropriate for the divided regions can be selected.

In this printing method, the print range is divided so as to arrange the divided regions along the carrying direction.

According to this printing method, the printing mode that is appropriate for the divided regions can be selected.

In this printing method, the predetermined region is an entire region of the print range of the medium.

According to this printing method, the printing mode that is appropriate for the entire region of the print range can be selected.

In this printing method, the number of the nozzles that can eject ink at the time of the dot forming process is different for each of a plurality of the printing modes.

According to this printing method, it is possible to suppress the glossy banding and the density variation banding by a plurality of the printing modes each with a different number of nozzles that can eject ink.

In this printing method, the printing mode with a small number of the nozzles that can eject ink at the time of the dot forming process is selected, when the number of the dots in the predetermined region is large.

According to this printing method, it is possible to suppress the glossy banding by the glossy banding suppressing printing mode with a small number of nozzles that can eject ink.

In this printing method, the printing mode with a large number of the nozzles that can eject ink at the time of the dot forming process is selected, when the number of the dots in the predetermined region is small.

According to this printing method, it is possible to suppress the density variation banding by the density variation banding suppressing printing mode with a large of number of nozzles that can eject ink.

In this printing method, in the printing mode with a smaller number of the nozzles that can eject ink at the time of the dot forming process, a ratio of the number of the dot rows formed using a large number of the nozzles to the number of the dot rows formed using a small number of the nozzles becomes smaller.

According to this printing method, in the glossy banding suppressing printing mode a ratio of the dot rows formed by a large number of nozzles to the dot rows formed by a small number of nozzles is small, and it is possible to print by suppressing the glossy banding.

In this printing method, in the printing mode with a larger number of the nozzles that can eject ink at the time of the dot forming process, a ratio of the number of the dot rows formed using a large number of the nozzles to the number of the dot rows formed using a small number of the nozzles becomes larger.

According to this printing method, in the density variation banding suppressing printing mode a ratio of the dot rows formed by a large number of nozzles to the dot rows formed by a small number of nozzles is large, and it is possible to print by suppressing the density variation banding.

In this printing method, the ink is pigment ink.

According to this printing method, when printing is performed by pigment ink, the glossy banding occurs due to the order that the dots overlap, but the glossy banding can be suppressed by the gloss banding suppressing printing mode.

In this printing system including:

a carrying unit for carrying a medium in a carrying direction;

a carriage for moving each nozzle of a plurality of nozzles arranged in the carrying direction; and a controller that causes printing of an image to be printed on a medium by causing a printing apparatus to alternately repeat a dot forming process for forming dots on the medium by ejecting ink from each of the nozzles moving in a movement direction with the carriage, and a carrying process for carrying the medium in the carrying direction, and causing the printing apparatus to form a plurality of rows of dots, lined up in the carrying direction, that are configured by a plurality of dots lined up in the movement direction, the controller that causes printing with a printing mode with a predetermined ratio of a ratio of the number of the dot rows formed using a different number of the nozzles to the number of the dot rows formed using a certain number of nozzles, wherein the controller can select a plurality of the printing modes each with a different ratio, wherein the controller determines the printing mode at the time of printing the region, according to the number of the dots formed in a predetermined region of the medium.

According to this printing system, the printing mode can be determined according to the number of the dots in the region, and the glossy banding and the density variation banding can be suppressed.

In this storage medium recorded with a driver for making a printer realize a function for printing an image to be printed on a medium by repeating alternately a dot forming process for forming dots on the medium by ejecting ink from each nozzle of a plurality of nozzles, and a carrying process for carrying the medium in a carrying direction, and forming a plurality of rows of dots, lined up in the carrying direction, that are configured by a plurality of dots lined up in a movement direction;

a function for selecting a printing mode according to the number of the dots to be formed in a predetermined region of the medium, from among a plurality of the printing modes, each with a different ratio of the number of dot rows formed using a different number of nozzles to the number of dot rows formed using a certain number of nozzles; and a function for printing on the region to be printed, based on the selected printing mode.

According to this storage medium, the printing mode can be determined according to the number of the dots in the region, and the glossy banding and the density variation banding can be suppressed.

===Configuration of Printing System===

Next, an embodiment of a printing system (computer system) is explained referring to the drawings. However, in the description of the below embodiment, an embodiment regarding a computer program, a storage medium having a computer program stored thereon, or the like is included.

FIG. 1 is an explanatory diagram showing an external configuration of the printing system. This printing system 100 includes a printer 1, a computer 110, a display device 120, input devices 130, and a recording and reproducing device 140. The printer 1 is a printing device for printing an image on a medium such as a paper, a cloth, or film. The computer 110 is electrically connected to the printer 1, and in order to make the printer 1 print an image, outputs print data according to the image to be printed to the printer 1. A display device 120 has a display, and displays a user interface such as an application program, a printer driver and the like. The input device 130 is, for example, a keyboard 130A and a mouse 130B, and is used with the user interface displayed on the display device 120 for operation of an application program or setting of a printer driver or the like. As the recording and reproducing device 140, for example, a flexible disk drive 140A or a CD-ROM drive device 140B is used.

A printer driver is installed in the computer 110. The printer driver is a program for achieving the function of displaying a user interface on the display device 120, and also for realizing the function of converting image data that has been output from the application program into print data. The printer driver is stored on a storage medium (a computer-readable storage medium) such as a flexible disk FD or a CD-ROM or the like. Further, this printer driver can be downloaded onto the computer 110 via the Internet. Note that, this program is configured by codes for achieving various functions.

Note that, a "printing apparatus" narrowly means a printer 1, but widely means a system of the printer 1 and the computer 110.

===Printer Driver===

Regarding the Printer Driver

Figure 2:
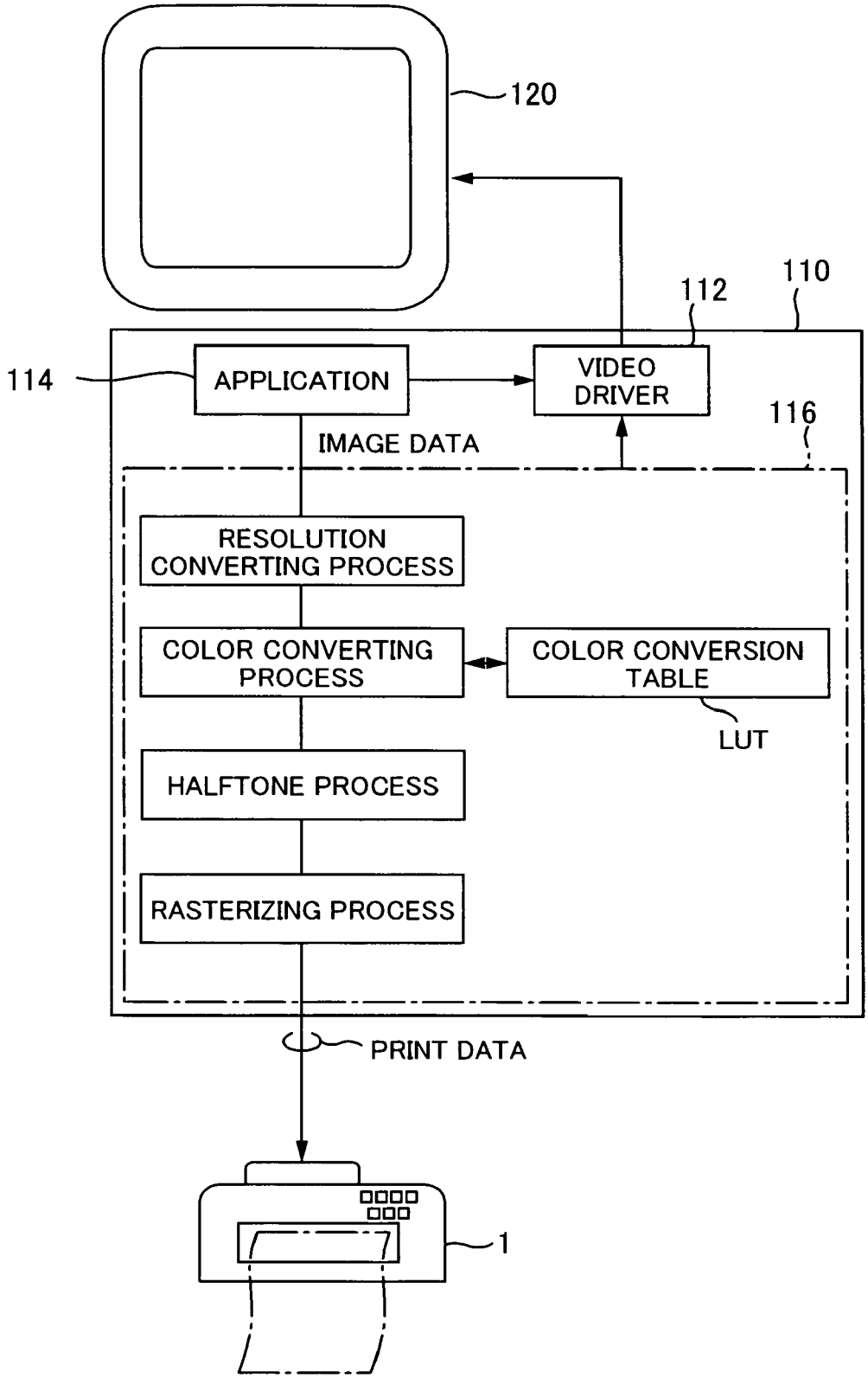
FIG. 2 is an explanatory diagram of basic processes performed by a printer driver.

FIG. 2 is a schematic explanatory diagram of basic processes performed by the printer driver. Structural elements that have already been described are assigned the same reference numerals, and their explanations are omitted.

On the computer 110, computer programs such as a video driver 112, an application program 114, and the printer driver 116 operate under an operating system installed on the computer. The video driver 112 has a function of displaying, for example, a user interface on the display device 120, in accordance with display commands from the application program 114 and the printer driver 116. The application program 114 has, for example, a function of editing an image or the like, and is a program for creating data (image data) relating to an image. A user can give an instruction to print an image edited by the application program 114, via a user interface of the application program 114. When the print instruction is received, the image data is output by the application program 114 to the printer driver 116.

The printer driver 116 receives the image data from the application program 114, converts the received image data into print data, and outputs the converted print data to the printer. Print data is data in a format that can be interpreted by the printer 1, and is data that has various types of command data and a pixel data. The command data is data for instructing the printer to perform a specific operation. Further, pixel data is data regarding pixels for configuring an image to be printed (printing image), and is, for example, data (data of the color and the size of a dot or the like) regarding a dot to be formed on a position on the paper corresponding to a certain pixel.

The printer driver 116 performs, for example, a resolution converting process, a color converting process, a halftone process, and a rasterizing process in order to convert the image data that has been output from the application program 114 into print data. The following is a description concerning the various processes performed by the printer driver 116.

The resolution converting process is a process for converting image data (such as text data and image data) that has been output from the application program 114 into the resolution when an image is printed on the paper. For example, if the resolution when printing an image on the paper is specified as 720×720 dpi, then the image data that has been received from the application program 114 is converted into image data having a resolution of 720×720 dpi. Note that, the image data after the resolution conversion processing, is RGB data of multiple grades (for example, 256 grades) expressed in RGB color space. Hereinbelow, RGB data that is image data that has been processed in the resolution conversion process, is referred to as RGB image data.

The color converting process is a process for converting RGB data into CMYK data expressed in CMYK color space. Note that, CMYK data is data corresponding to colors of ink provided in the printer. The color converting process is performed by the printer driver 116 referring to a table (color conversion lookup table LUT) in which gradation values of RGB image data are associated with gradation values of CMYK image data. By this color conversion process, RGB data regarding each pixel is converted to CMYK data corresponding to the ink color. Note that, data for after the color conversion process is CMYK data of 256 grades expressed by the CMYK color space. Hereinbelow, CMYK data which is RGB image data that has been processed by the color conversion process, is referred to as CMYK image data.

The halftone process is a process for converting data having gradation values of multiple grades into data having gradation values that can be expressed by the printer. For example, with the halftone process, data indicating gradation values of 256 grades is converted into one-bit data indicating gradation values of two grades and two-bit data indicating gradation values of four grades. As the halftone process, for example, dithering, γ-correction or error diffusion is used to create pixel data with which the printer can form dispersed dots. When the printer driver 116 performs a halftone process, when dithering is performed a dither table is referred to, when a γ-correction is performed a gamma table is referred, and when error diffusion is performed an error memory for storing an error that is diffused is referred to. The data that has been processed by the halftone process has a resolution (for example, 360×360 dpi) that is the same as the above described RGB data. The image data on which the halftone process has been performed, is configured by, for example, one bit or two bit pixel data for each pixel.

The rasterizing process is a process for rearranging the matrix image data into the data order in which it is to be transferred to the printer. Data on which the rasterizing process has been performed is output to the printer as the pixel data included in the print data.

Regarding Setting of the Printer Driver

Figure 3:
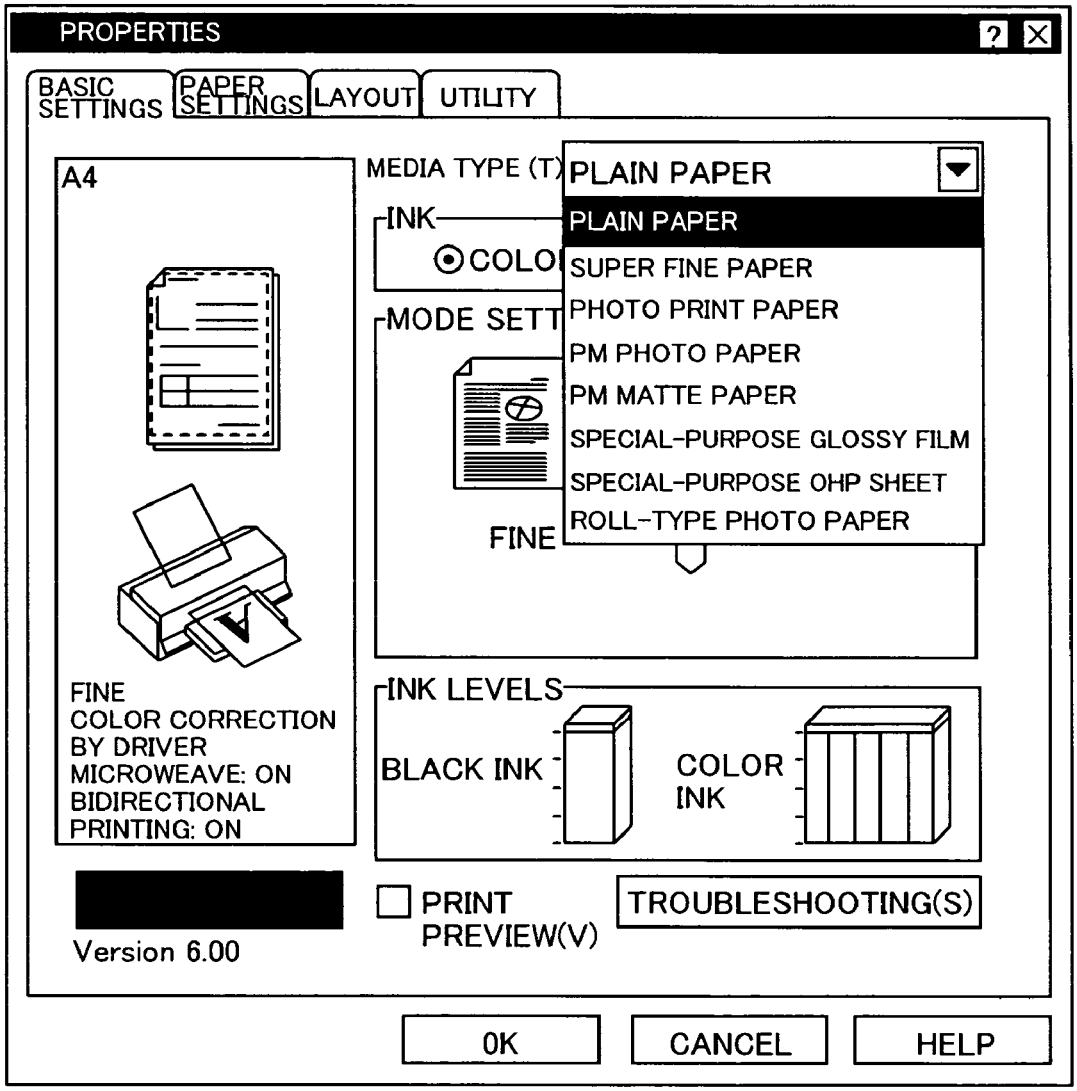
FIG. 3 is an explanatory diagram of a user interface of the printer driver.

FIG. 3 is an explanatory diagram showing a user interface of a printer driver. The user interface of the printer driver is displayed on a display device connected via the video driver 112. A user can use the input device 130 to make various settings of the printer driver.

The user can select the print mode from this screen. For example, the user can select as the print mode, a quick print mode or a fine print mode. Then, the printer driver converts the image data into print data to become a format according to a print mode that has been selected.

From this screen, the user can select the print resolution (the dot spacing when printing). For example, from this screen, the user can select 720 dpi or 360 dpi as the print resolution. Then, the printer driver performs resolution conversion process according to a selected resolution, and converts the image data to print data.

Further, the user can select the print paper used for printing from this screen. For example, the user can select as print paper, an ordinary paper or a glossy paper. If the type of paper (kind of paper) differs, the way ink spreads and the way ink dries also differs, so that the ink amount that is adequate for printing also differs. Thus, the printer driver converts image data into print data according to the selected paper type.

Thus, the printer driver converts the image data into the print data according to the conditions that are set via the user interface. Note that, from this screen, the user can perform various settings of the printer driver, as well as know the residual amount of ink in the cartridge or the like.

===Configuration of the Printer===

Regarding Configuration of Inkjet Printer

Figure 4:
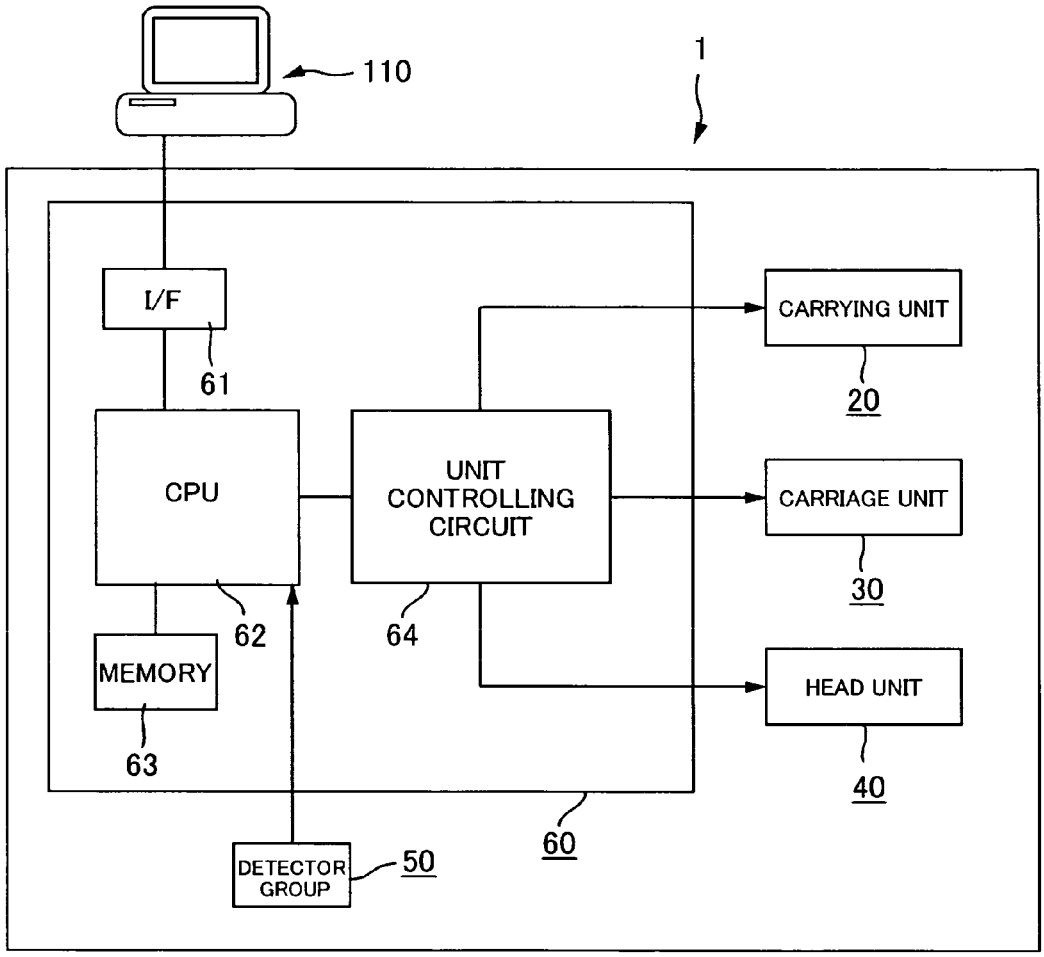
FIG. 4 is a block diagram of an entire structure of a printer.
Figure 5:
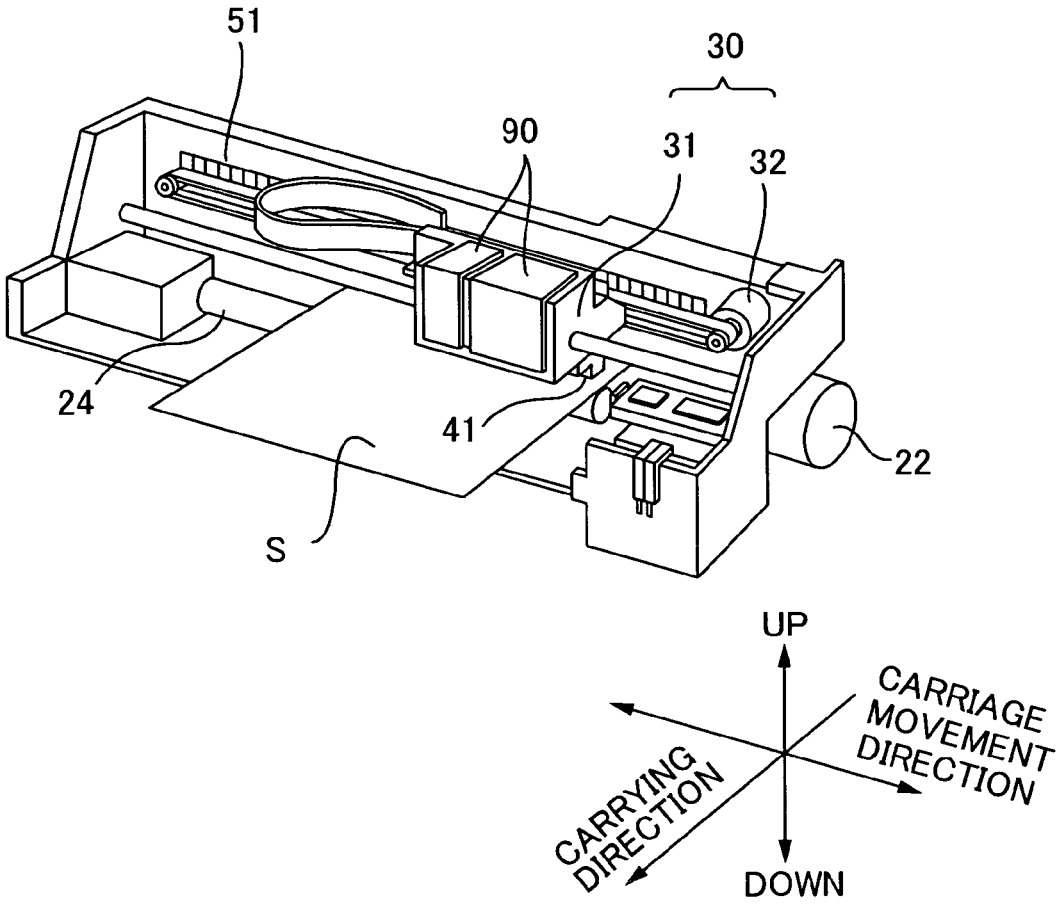
FIG. 5 is a schematic diagram of the entire structure of the printer.
Figure 6:
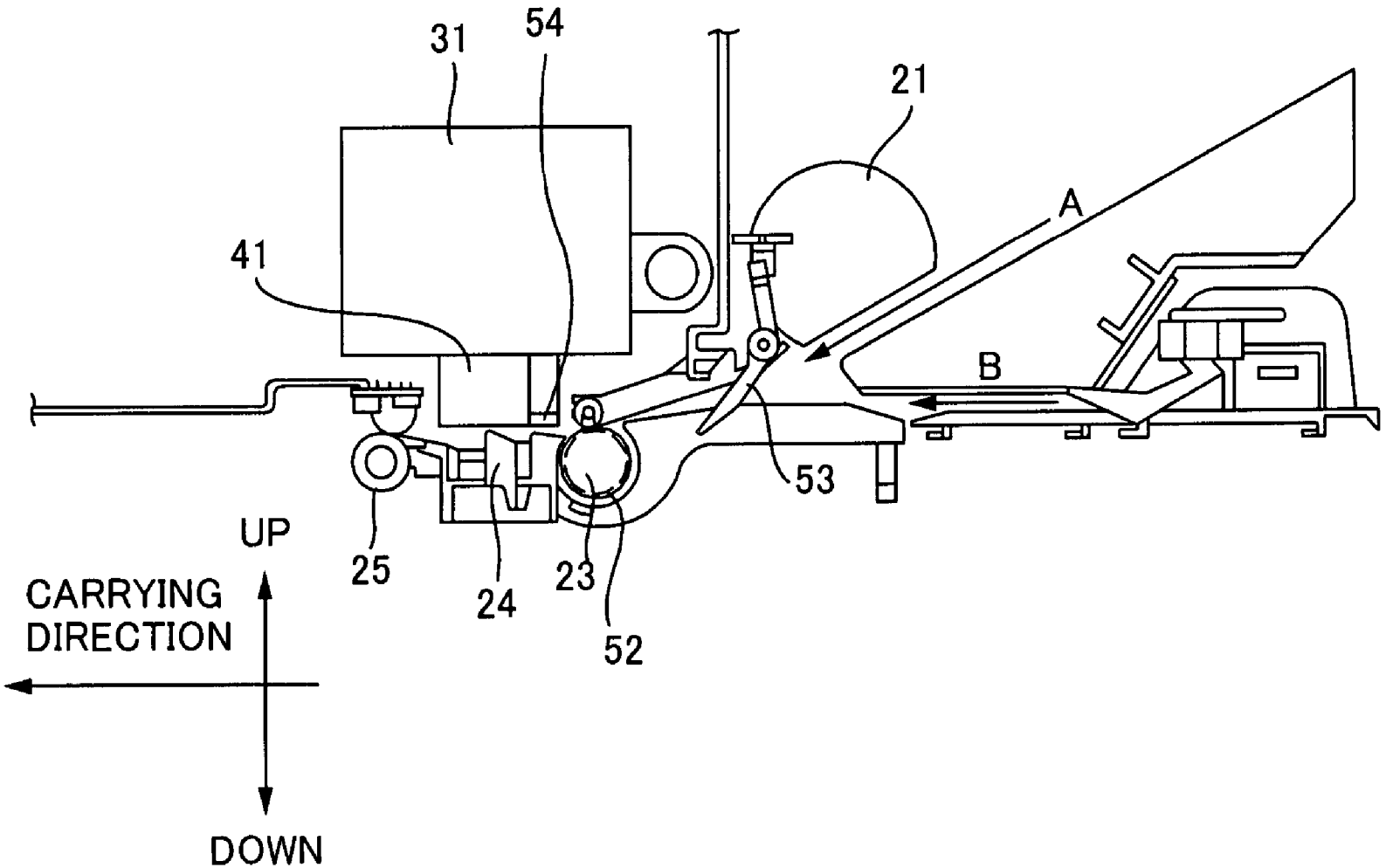
FIG. 6 is a side sectional view of the entire structure of the printer.

FIG. 4 is a block diagram explaining the overall configuration of the printer of this embodiment. Further, FIG. 5 is a schematic view explaining the overall configuration of the printer of this embodiment. FIG. 6 is a horizontal sectional view explaining the overall configuration of the printer of this embodiment. Hereinbelow, the basic structures of the printer of this embodiment is explained.

The printer of this embodiment includes a paper carry unit 20, a carriage unit 30, a head unit 40, a detector group 50, and a controller 60. The printer 1, upon receiving print data from the computer 110, which is an external device, controls each unit (the paper carry unit 20, the carriage unit 30, and the head unit 40) by the controller 60. The controller 60 controls each unit according to print data received from the computer 110, and forms an image on the paper. The conditions in the printer 1 are monitored by the detector group 50, and the detector group 50 output detection results to the controller 60. The controller 60 that has received the detection results from the detectors 50 controls each unit based on the detection results.

The carry unit 20 is for sending a medium (for example, paper S) to a printable position, and carrying the paper by a predetermined carrying amount in a predetermined direction (hereinbelow, carrying direction) during printing. That is, the carry unit 20 functions as a carrying mechanism for carrying the paper (carrying section). The carry unit 20 includes a paper supplying roller 21, a carrying motor 22 (also referred to as a PF motor), a carrying roller 23, a platen 24, and a paper-discharge roller 25. However, in order for the carry unit 20 to function as a carrying mechanism, all of the structural elements are not necessary. The paper supplying roller 21 is a roller for automatically supplying the paper that has been inserted into a paper insert opening into the printer. The paper supplying roller 21 has a D-shaped cross-sectional shape, and the length of the circumferential portion is set longer than a carrying distance to the carrying roller 23, so that the paper can be carried to the carrying roller 23 using the circumferential portion. The carrying motor 22 is a motor for carrying the paper in the carrying direction, and is constituted by a DC motor. The carrying roller 23 is a roller for carrying the paper S that has been supplied by the paper supplying roller 21 to a printable region, and the carry roller 23 is driven by the carrying motor 22. The platen 24 is a member that supports the paper S on which printing is being performed. The paper-discharge roller 25 is a roller for discharging the paper S for which printing has finished to outside the printer. The paper-discharge roller 25 rotates in synchronization with the carry roller 23.

The carriage unit 30 is for making the head move (also referred to as "scan") in a predetermined direction (hereinafter, this is referred to as "movement direction"). The carriage unit 30 has a carriage 31, and a carriage motor 32 (hereinafter, referred to as "CR motor"). The carriage 31 can be moved to reciprocate in the movement direction (thus, the head moves along the movement direction). Moreover, the carriage 31 removably holds an ink cartridge that accommodates ink. The carriage motor 32 is a motor for moving the carriage 31 in the movement direction, and is constituted by a DC motor.

The head unit 40 is for ejecting ink onto a paper. The head unit 40 includes a head 41. The head 41 has a plurality of nozzles that are ink ejection portions, and ejects ink intermittently from each nozzle. This head 41 is provided to the carriage 31. Thus, when the carriage 31 moves in the movement direction, the head 41 also moves in the movement direction. Then, by intermittently ejecting ink during the moving of the head 41 in the movement direction, a dot line (raster line) along the movement direction is formed on the paper.

The detector group 50 includes a linear encoder 51, a rotary encoder 52, a paper detection sensor 53, and an optical sensor 54. The linear encoder 51 is for detecting the position of the carriage 31 in the movement direction. The rotary encoder 52 is for detecting the amount of rotation of the carry roller 23. The paper detection sensor 53 is for detecting the position of the front end of the paper to be printed. The paper detection sensor 53 is provided in a position where it can detect the position of the front end of the paper as the paper is being supplied toward the carry roller 23 by the paper supply roller 21. It should be noted that the paper detection sensor 53 is a mechanical sensor that detects the front end of the paper through a mechanical mechanism. More specifically, the paper detection sensor 53 has a lever that can be rotated in the paper carrying direction, and this lever is disposed so that it protrudes into the path along which the paper is carried. Thus, the front end of the paper comes into contact with the lever and the lever is rotated, and the paper detection sensor 53 detects the position of the front end of the paper by detecting the movement of the lever. The optical sensor 54 is attached to the carriage 31. The optical sensor 54 detects whether the paper exists or not by a light receiving section detecting light irradiated from a light emitting section that is reflected by the paper. The optical sensor 54 detects the position of the edge of the paper while being moved by the carriage 31. The optical sensor 54 optically detects the edge of the paper, thus detects positions with higher precision than the mechanical paper detection sensor 53.

The controller 60 is a control unit (controlling means) for carrying out control of the printer. The controller 60 has an interface section 61, a CPU 62, a memory 63, and a unit control circuit 64. The interface section 61 is for exchanging data with a computer 110 which is an external device with the printer 1. The CPU 62 is an arithmetic processing device for carrying out the overall control of the printer. The memory 63 is for reserving an area for storing the programs for the CPU 62 and a working area, for example, and has a storage section such as a RAM or an EEPROM. According to a program stored in the memory 63, the CPU 62 controls each unit via the unit control circuit 64.

Regarding the Printing Operation

Figure 7:
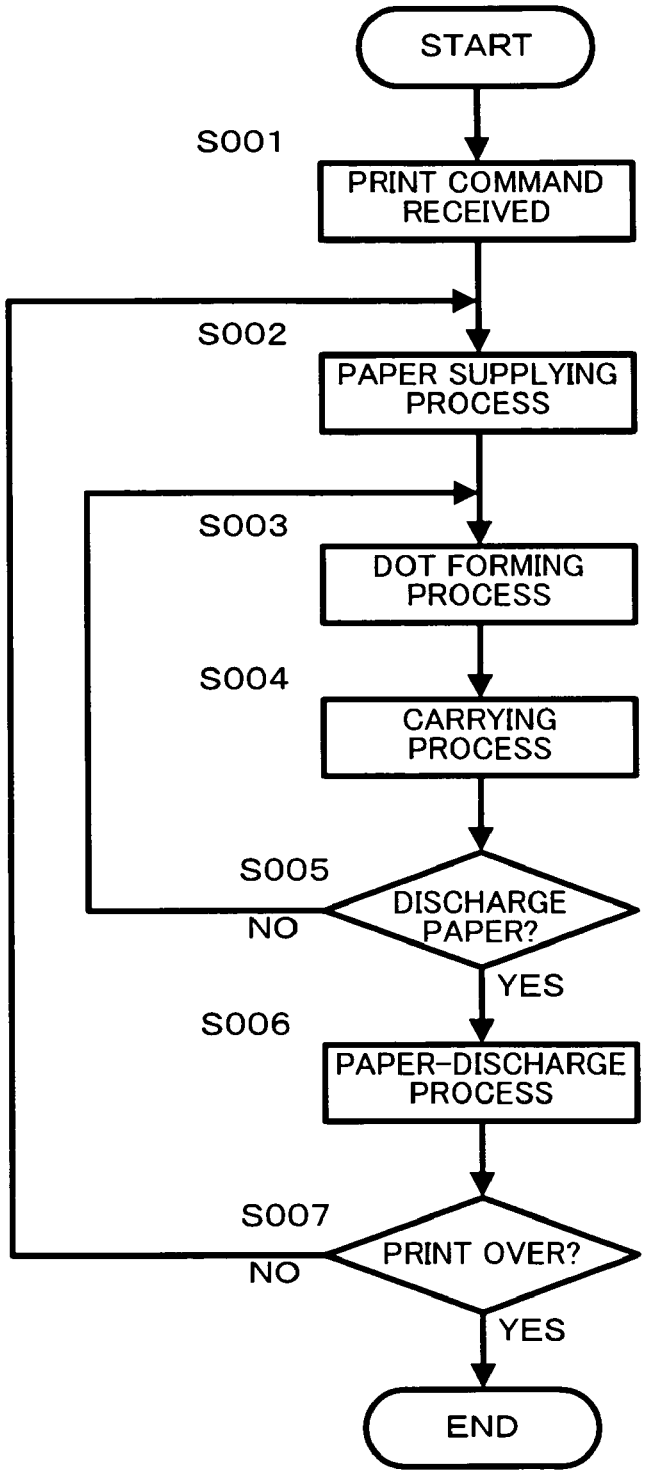
FIG. 7 is a flow diagram of the processes when printing.

FIG. 7 is a flow chart describing processes during printing. Each of the processes described below are executed by the controller 60 controlling each unit, in accordance with programs stored in the memory 63. The programs contain codes to carry out each of the processes.

Receive Print Command (S001): First, the controller 60, receives a print command from the computer 110 via an interface portion 61. The print command is included in a header of print data sent from the computer 110. The controller 60 analyzes the contents of various commands included in the received print data, and using each unit, performs the following such as a paper supplying process, a carrying process, and an ink ejecting process.

Paper Supplying Process (S002): The paper supplying process is a process for supplying the paper to be printed in the printer, and positioning the paper at a print start position (also referred to as the "indexing position"). The controller 60 rotates the paper supplying roller 21, and sends the paper to be printed to the carry roller 23. The controller 60 rotates the carry roller 23, and positions the paper that has been sent from the paper supplying roller 21 to the print start position. When the paper has been positioned in the print start position, at least some of the nozzles of the head 41 are opposed to the paper.

Dot forming process (S003): The dot forming process is a process for forming dots on the paper by intermittently ejecting ink from a head that is moving along the movement direction. The controller 60 drives the carriage motor 32, and moves the carriage 31 in the movement direction. Then, the controller 60 makes ink be ejected from the head based on the print data, while the carriage 31 is moving. When an ink droplet ejected from the head lands on the paper, a dot is formed on the paper. Ink is ejected intermittently from the moving head, thus a dot line made of a plurality of dots along the movement direction is formed on the paper.

Carrying process (S004): The carrying process is a process for moving relatively the paper in respect to the head in the carrying direction. The controller 60 drives the carrying motor, rotates the carrying roller and carries the paper in the carrying direction. By this carrying operation, dots can be formed by the head 41 at positions that are different from those dots formed in the previous dot forming process.

Paper Discharge Determination (S005): The controller 60 performs a determination of whether or not to discharge the paper that is being printed. If there is data that is to be printed on the paper that is being printed, then discharge is not performed. The controller 60 alternately repeats the dot forming process and the carrying process, and gradually prints the image to be configured by the dots on the paper, until there is no more data to be printed.

Paper Discharge Process (S006): When there is no more data to be printed on the paper being printed, the controller 60 rotates the discharge roller to discharge the paper. Note that, the determination to perform discharge or not can be based on a paper discharge command included in the print data.

Print Over Determination (S007): Next, the controller 60 determines whether or not to continue printing. If printing is to be performed on the next paper, printing is continued, and a paper supply operation for the next paper is started. If printing is not to be performed on the next paper, the printing operation is ended.

Regarding Nozzles

Figure 8:
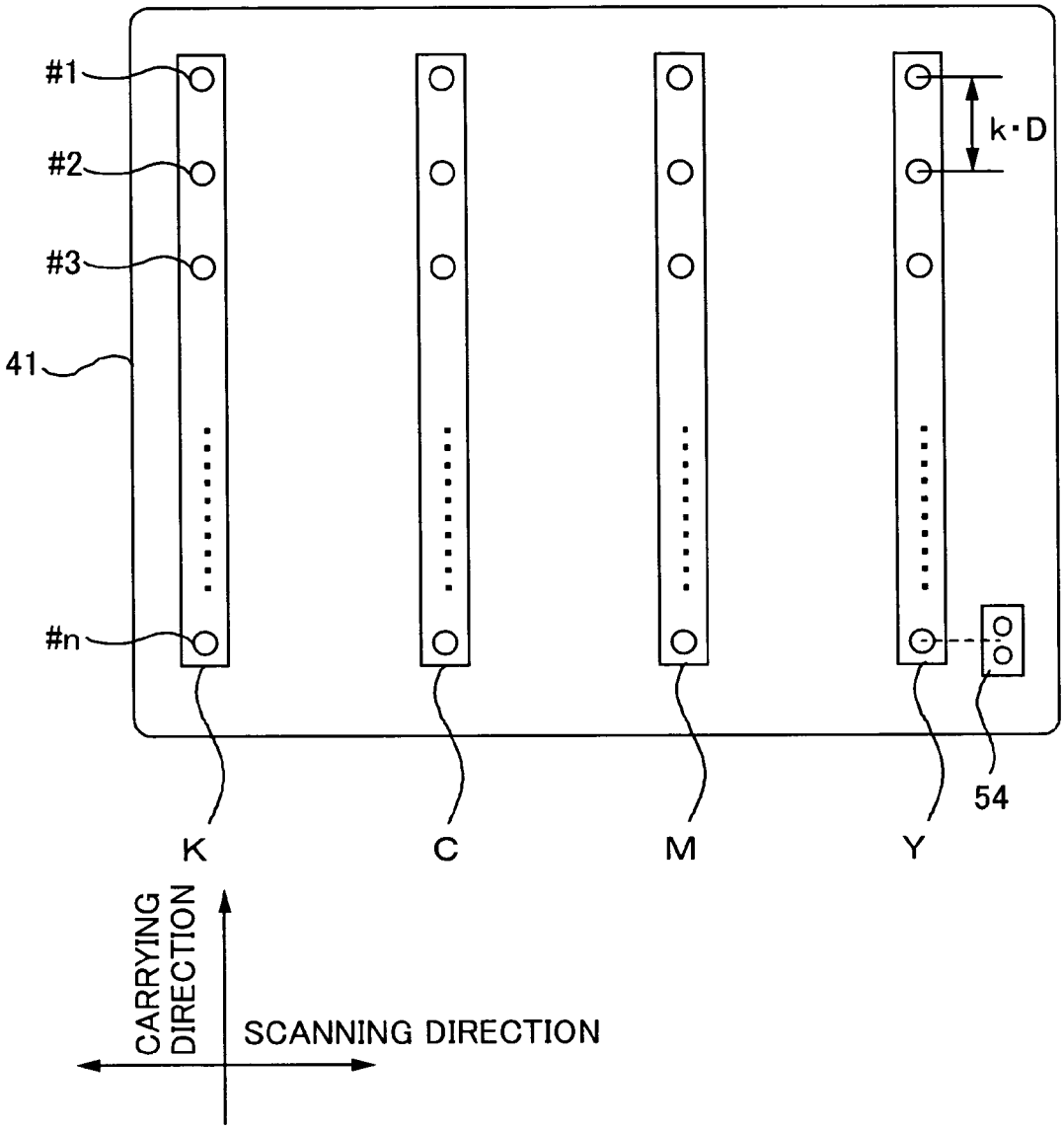
FIG. 8 is an explanatory diagram showing an arrangement of nozzles.

FIG. 8 is an explanatory diagram showing the arrangement of nozzles on the lower face of a head 41. A black ink nozzle row K, a cyan ink nozzle row C, a magenta ink nozzle row M, and a yellow ink nozzle row Y are formed on the lower face of the head 41. Each of the nozzle rows is provided with a plurality of nozzles (180 in this embodiment) that are ejection openings for ejecting ink of the respective colors.

The plurality of nozzles of each of the nozzle rows are arranged in a row at a constant spacing (nozzle pitch: k·D) in the carrying direction. Herein, D is the minimum dot pitch in the carrying direction (that is, the spacing of dots formed on the paper S at the highest resolution). Also, k is an integer of 1 or more. For example, if the nozzle pitch is 180 dpi (1/180 inch) and the dot pitch in the carrying direction is 360 dpi (1/360 inch), then k=2.

The nozzles of each of the nozzle rows are assigned numbers (#1 to #180) that become smaller toward the nozzles on the downstream side. More specifically, the nozzle #1 is positioned on the downstream side of the nozzle #180 in the carrying direction. Each nozzle is provided with a piezo element (not shown) as a driving element for driving each nozzle to eject an ink droplet. Further, the optical sensor 54 is positioned at approximately the same position as a nozzle #180 at the most upstream side, in regards to a position in the paper carrying direction.

===Printing Mode of a Reference Example===

Reference Example: Interlace Printing

Figure 9A:
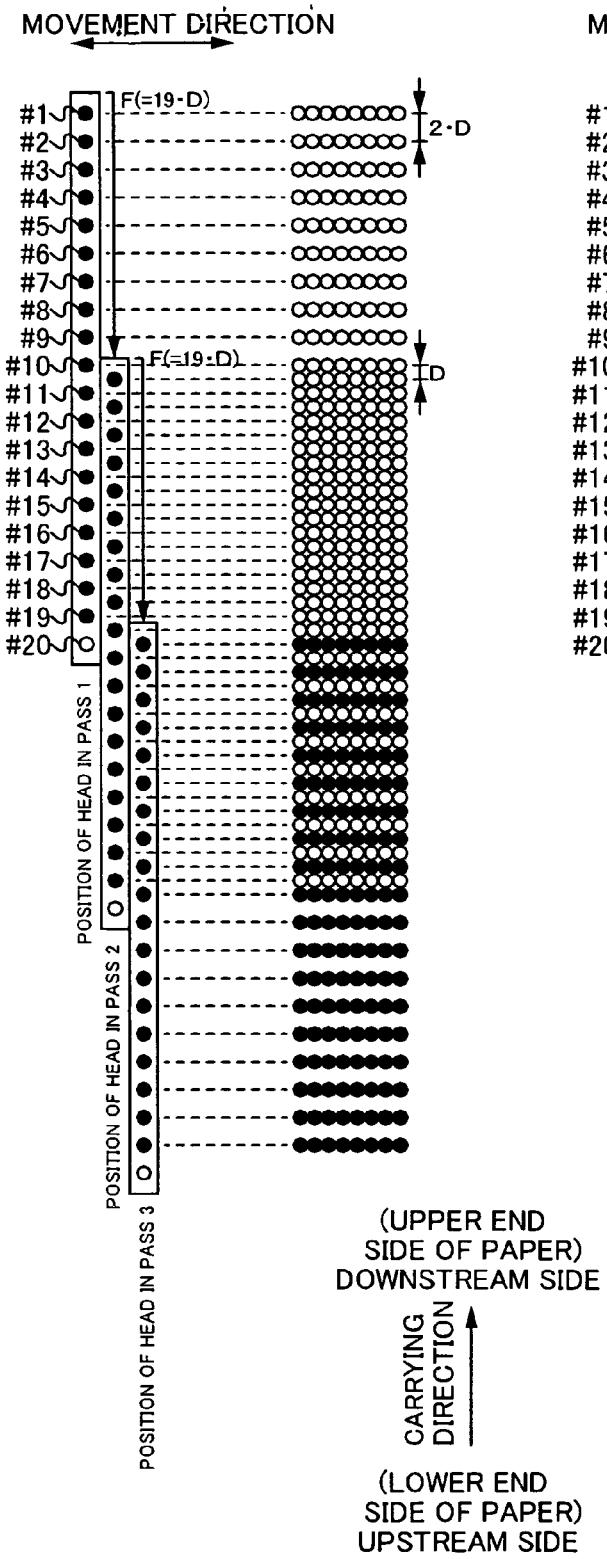
FIG. 9A is an explanatory diagram of an interlace printing.
Figure 9B:
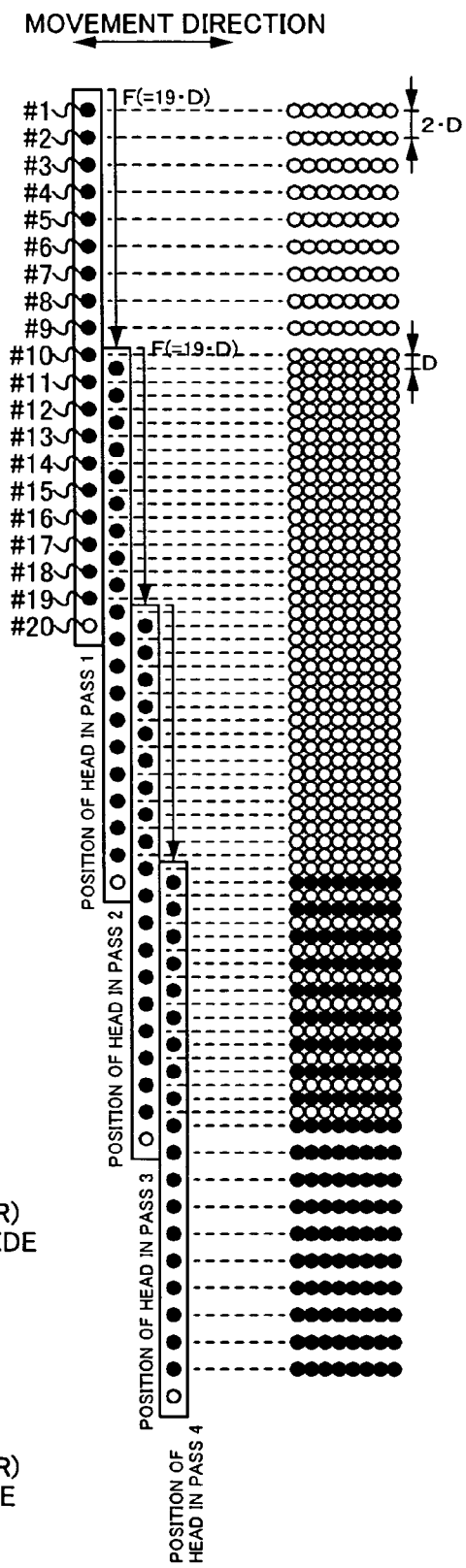
FIG. 9B is an explanatory diagram of the interlace printing.

FIGS. 9A and 9B are explanatory diagrams of interlace printing. FIG. 9A shows the positions of the nozzles in pass 1 to pass 3 and how dots are formed, and FIG. 9B shows the positions of the nozzles in pass 1 to pass 4 and how dots are formed.

For convenience of explanation, only one nozzle row of the four nozzle rows are shown, and the number of the nozzles of the nozzle row is decreased (here, 20). Nozzles shown in black circles in the figure are nozzles that can eject ink. On the other hand, nozzles that are shown by empty circles, are nozzles that cannot eject ink. Further, for convenience of explanation, the nozzle rows are shown as moving with respect to the paper, but the diagram shows the relative positions of the nozzle row and the paper, and in actuality the paper is moved in the carrying direction. Further, for convenience of explanation, each nozzle is shown as forming only several dots (circles in the figure), however, in actuality ink droplets are being intermittently ejected from the nozzles that move in the movement direction, thus a plurality of dots are aligned in the movement direction. This dot row is also referred to as a raster line. Dots shown by solid circles are dots formed in the last pass, and dots shown by empty circles are dots formed in previous passes. Note that, a "pass" refers to a process for forming dots (dot forming process) by ejecting ink from moving nozzles. Each pass alternately performs the dot forming process and a process for carrying a paper in the carrying direction (carrying process). The nth pass is referred to as "pass n".

"Interlace printing" refers to a printing method in which k is at least 2 and a raster line that is not recorded is sandwiched between raster lines that are recorded in a single pass. For example, in the printing method in FIG. 9A and FIG. 9B, one raster line is sandwiched between raster lines formed in one pass.

With interlace printing, every time the paper is carried in the carrying direction by a constant carry amount F, each nozzle records a raster line adjacent to the raster line that was recorded in the previous pass. In order to perform recording while keeping the carry amount constant in this manner, the conditions are (1) the number N (integer) of nozzles that are allowed to eject ink and k are coprime, and (2) the carry amount F is set to N·D.

In the figure, the nozzle row has 20 nozzles arranged in the carrying direction. Since the nozzle pitch k of the nozzle group is 2, the condition for performing interlace printing, that is, "N and k are coprime", is satisfied, so that not all the nozzles are used, and 19 nozzles (nozzle #1 to nozzle #19) are used. Further, since 19 nozzles are used, the paper is carried with a carry amount of 19·D. As a result, dots are formed on the paper with a dot spacing of 360 dpi (=D) using the nozzle group with a nozzle pitch of 180 dpi (2·D). Note that, the actual number of nozzles is more than 19, so that the actual carry amount is more than 19·D.

Reference Example: Full Overlap Printing

Figure 10A:
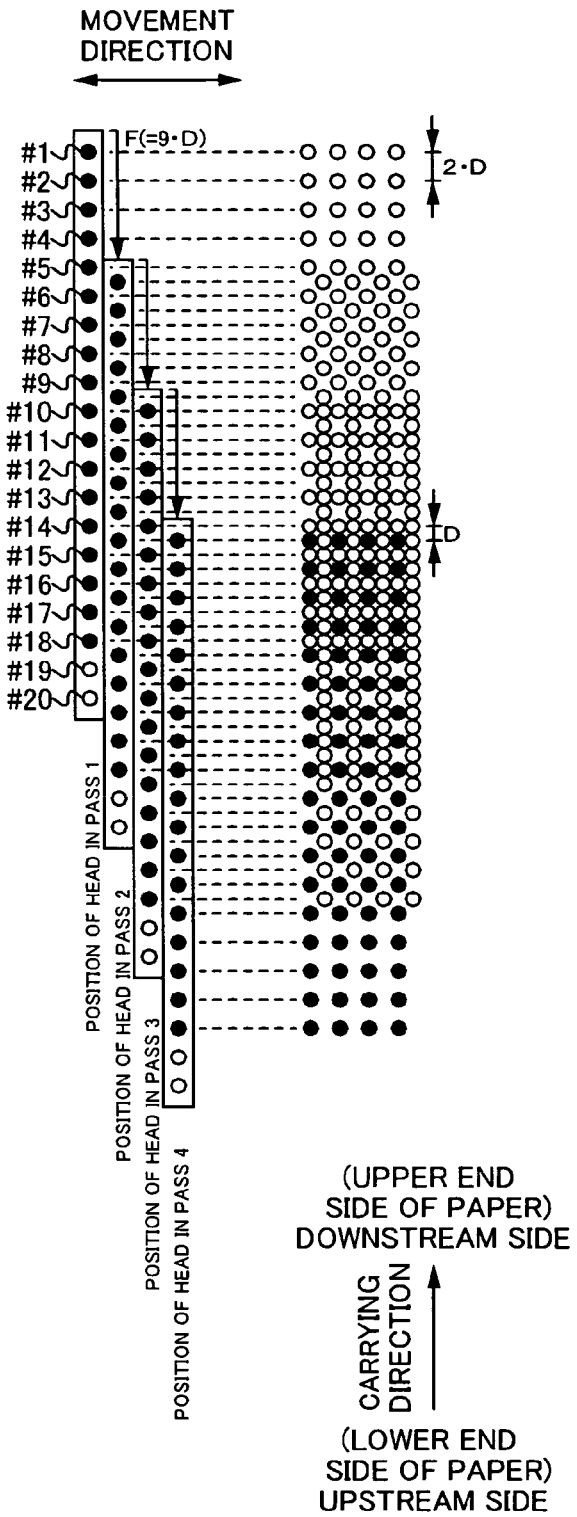
FIG. 10A is an explanatory diagram of full overlap printing.
Figure 10B:
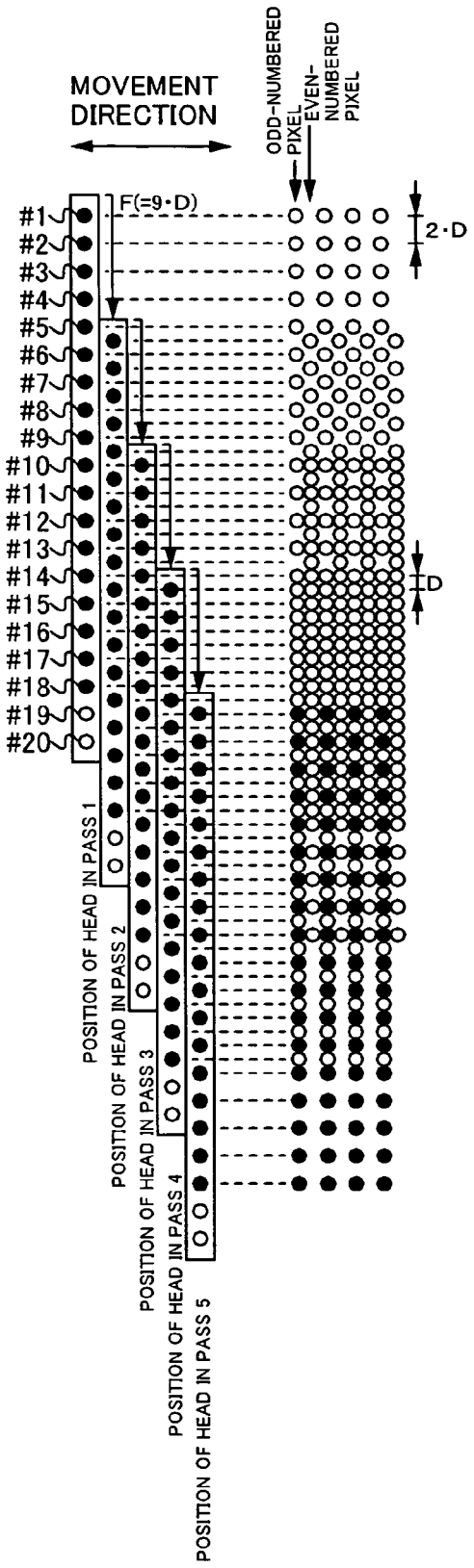
FIG. 10B is an explanatory diagram of the full overlap printing.

FIG. 10A and FIG. 10B are explanatory diagrams of full-overlap printing. FIG. 10A shows the positions of the head and how dots are formed in pass 1 to pass 4, and FIG. 10B shows the positions of the head and how dots are formed in pass 1 to pass 5.

"Full overlap printing" refers to a printing method by which a raster line is formed by a plurality of nozzles. For example, in the printing method in FIG. 10A and FIG. 10B, each raster line is formed by two nozzles.

In the full-overlap printing, each time the paper is carried in the carrying direction by a constant carry amount F, each nozzle forms dots intermittently at every several dots. Then, by letting another nozzle form dots in another pass to complement the intermittent dots that have already been formed (to fill in between the dots), a single raster line is formed by a plurality of nozzles. "Overlap number M" is defined as the number of passes M required to form a single raster line.

In FIGS. 10A and 10B, since each nozzle forms dots intermittently at every other dot, dots are formed in every pass either at the odd-numbered pixels or at the even-numbered pixels. Since a single raster line is formed by two nozzles, the overlap number M=2.

In overlap printing, conditions to carry out recording with a constant carry amount are: (1) N/M is an integer; (2) N/M and k are coprime; and (3) the carry amount F is set to (N/M)·D.

In FIGS. 10A and 10B, the nozzle row has 20 nozzles arranged in the carrying direction. However, since the nozzle pitch k of the nozzle row is 2, not all the nozzles can be used so that the condition for performing overlap printing, that is, "N/M and k are coprime", is satisfied. Therefore, 18 nozzles of the 20 nozzles are used to perform overlap printing. Moreover, since 18 nozzles are used, the paper is carried using a carry amount of 9·D. As a result, dots are formed on the paper with a dot spacing of 360 dpi (=D) using the nozzle row with a nozzle pitch of 180 dpi (2·D), for example.

In FIG. 10A and FIG. 10B, each nozzle forms dots at odd-numbered pixels in pass 1, each nozzle forms dots at even-numbered pixels in pass 2, each nozzle forms dots at odd-numbered pixels in pass 3, and each nozzle forms dots at odd-numbered pixels in pass 4. That is, in the four passes, dots are formed in the order of odd-numbered pixels, even-numbered pixels, even-numbered pixels, odd-numbered pixels. Note that, the dot formation order in or after pass 5 is the same as the dot formation order from pass 1.

Reference Example: Partial Overlap Printing

Figure 11A:
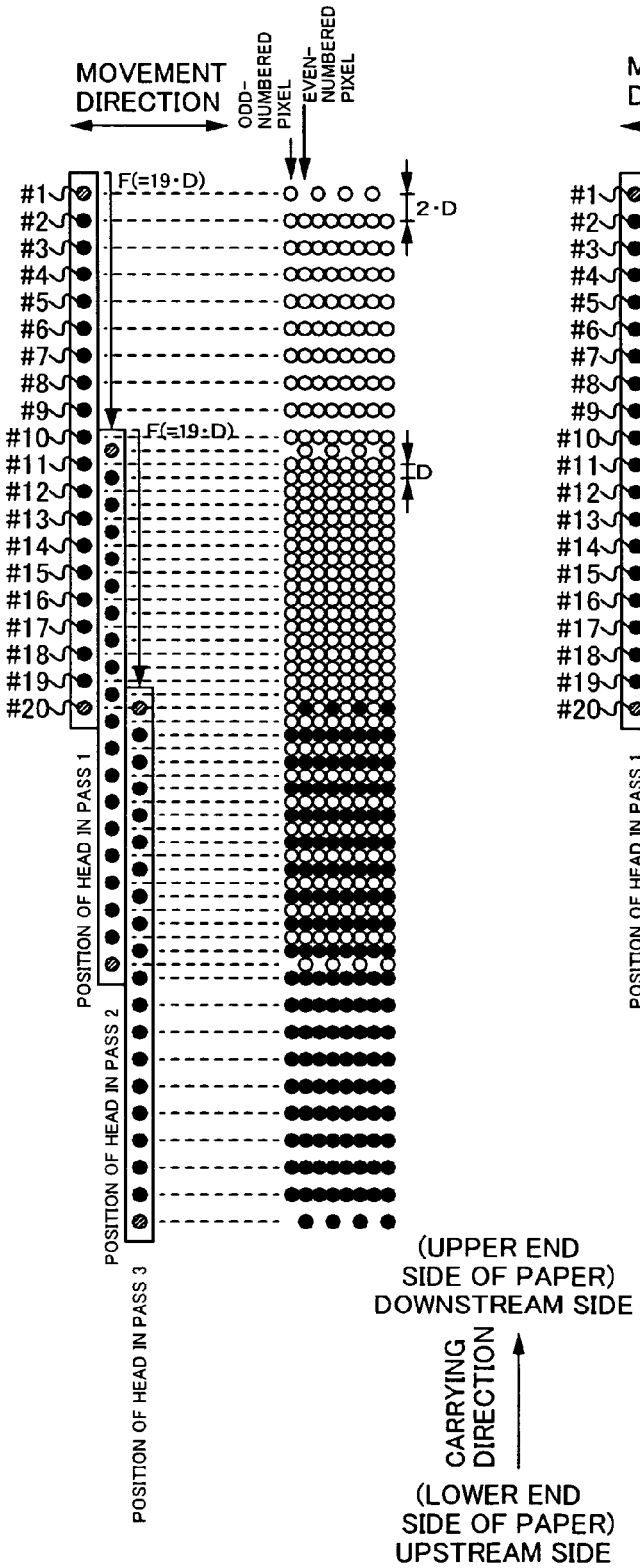
FIG. 11A is an explanatory diagram of partial overlap printing.
Figure 11B:
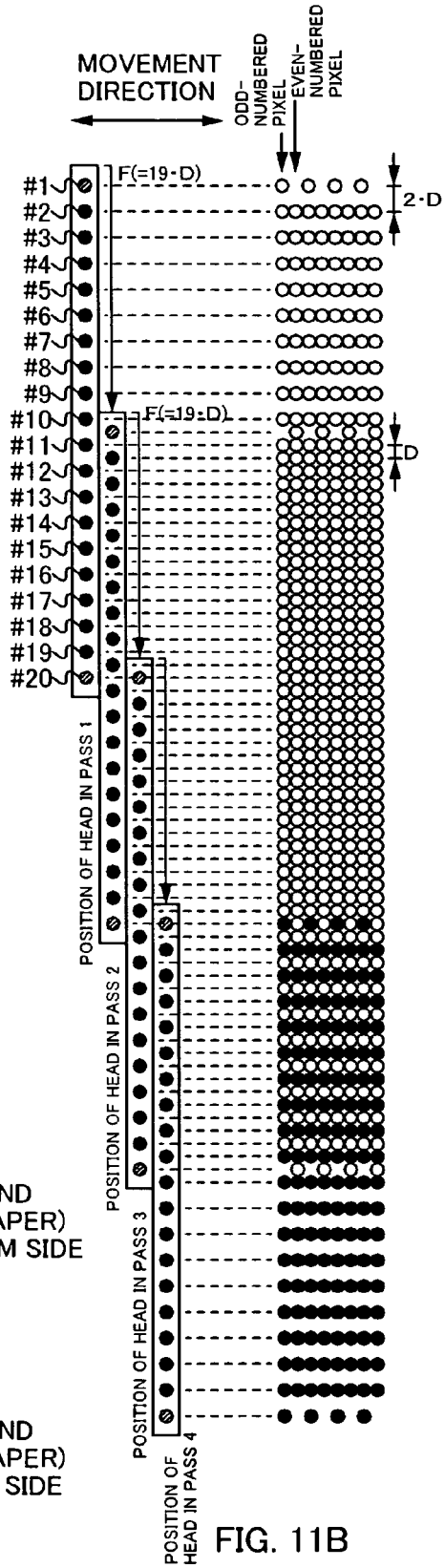
FIG. 11B is an explanatory diagram of the partial overlap printing.

FIG. 11A and FIG. 11B are explanatory diagrams of partial overlap printing. FIG. 11A shows the positions of the head and how dots are formed in pass 1 to pass 3, and FIG. 11B shows how dots are formed in pass 1 to pass 4.

In the partial overlap printing, as compared with the interlace printing (refer to FIG. 9A and FIG. 9B), the number of nozzles that can be used is set in a redundant manner. Due to this redundancy in the nozzles, the number of dots formed by a part of the nozzles is reduced to half of that formed by an ordinary nozzle. In the following explanation, a nozzle for which the number of dots formed by that nozzle is reduced to half of that of the ordinary nozzle is called a "POL nozzle". In FIG. 11A and 11B, the nozzles shown by solid circles are nozzles that that eject ink normally, and nozzles that are hatched by hatch lines are POL nozzles.

In the partial overlap printing, two nozzles, a nozzle located at the end portion in the carrying direction upstream side of a nozzle row and a nozzle located at the end portion in the carrying direction downstream side of the nozzle row, perform the same function as a single nozzle located in the central portion of that nozzle row. For example, in FIG. 11A and FIG. 11B, the nozzle #1 and the nozzle #20 form only a half number of dots compared with the nozzle #2 to nozzle #19. Namely, the nozzle #1 and the nozzle #20 are POL nozzles. However, the number of nozzles that can eject ink in FIGS. 11A and 11B is greater as compared with the number of nozzles that can eject ink in FIG. 9A and FIG. 9B.

In the partial overlap printing, a POL nozzle located at the end portion in the carrying direction upstream side intermittently forms dots. Then, the POL nozzle located at the end portion in the carrying direction downstream side forms dots in another pass so as to complement the intermittent dots that have already been formed (so as to fill in a space between dots). Thus, two POL nozzles located at the end portions perform the same function as one nozzle located in the central portion. For example, in FIGS. 11A and 11B, after the nozzle #20 forms dots intermittently at every other dot in a certain pass, the nozzle #1 forms dots to fill in the space between the above dots in another pass, and one raster line is completed.

In the partial overlap printing, as in the above-described interlace printing, a carry operation by a constant carrying amount F is carried out alternately with each pass. In order to carry out printing in this manner with a constant carrying amount, it is necessary to satisfy the two conditions that (1) the total number N' of nozzles is coprime to k, and (2) the carrying amount F is set to N'·D. Here, "the total number of nozzle N'" is a total nozzle number obtained by counting a nozzle in the central portion as "1" and counting a POL nozzle that forms only a half number of dots as "0.5". For example, in FIGS. 11A and 11B, the total nozzle number N' is "19".

Reference Example: Non-Uniform Overlap Printing 1

In the above-described partial overlap printing, the number of usable nozzles is set in a more redundant manner than in the foregoing interlace printing. However, it is possible to set the number of usable nozzles in a more redundant manner in respect to the foregoing full overlap printing.

Figure 12A:
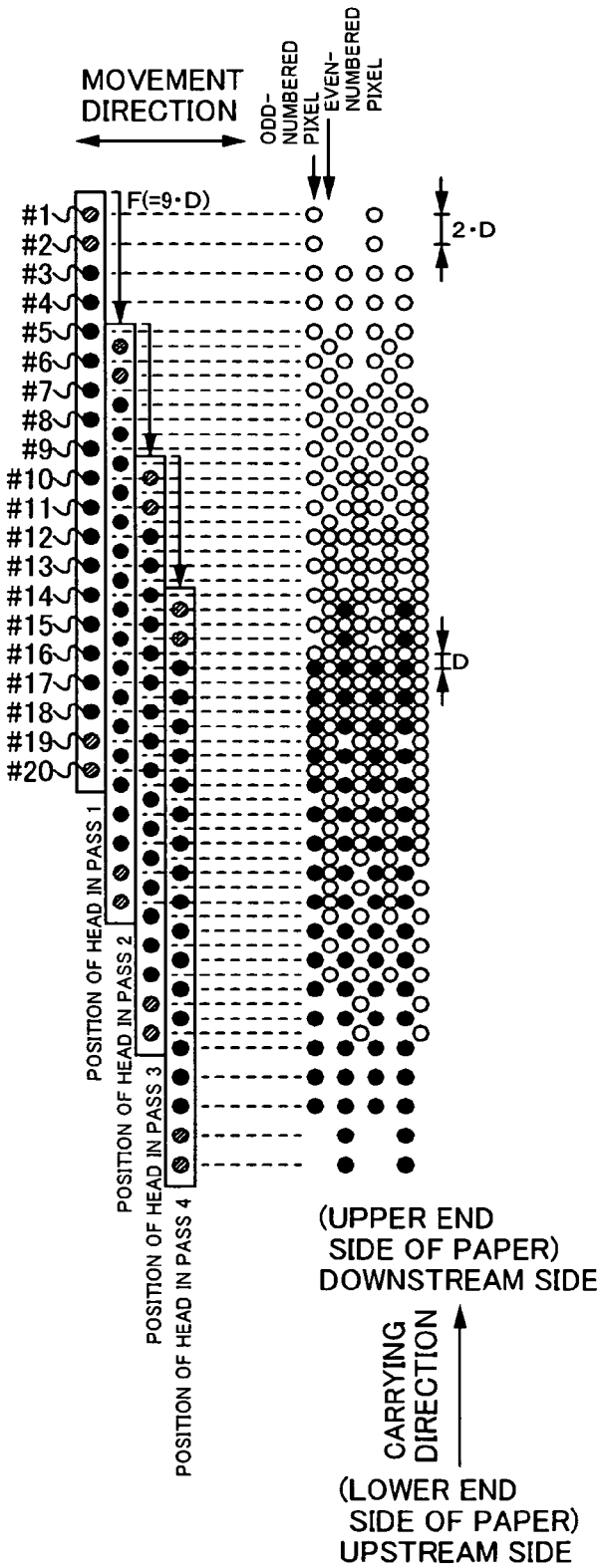
FIG. 12A is an explanatory diagram of a non-uniform overlap printing.
Figure 12B:
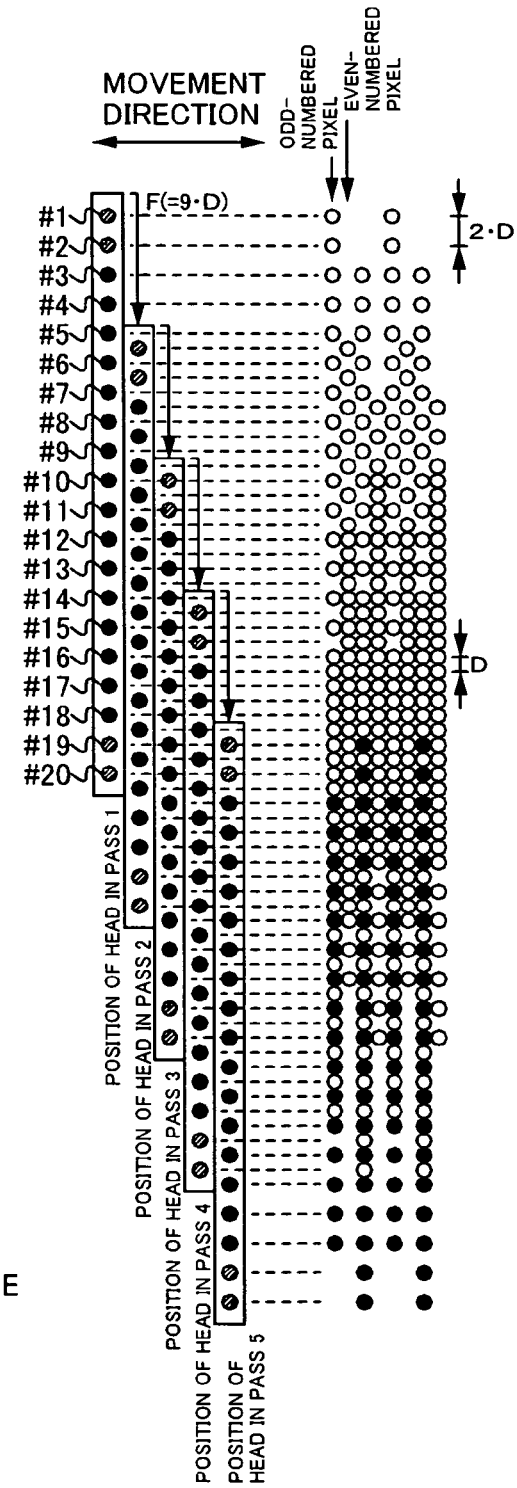
FIG. 12B is an explanatory diagram of the non-uniform overlap printing.

FIGS. 12A and 12B are explanatory diagrams of the non-uniform overlap printing. FIG. 12A shows the positions of the head and how dots are formed in pass 1 to pass 4, and FIG. 12B shows the positions of the head and how dots are formed in pass 1 to pass 5.

In this case, the nozzles #3 to #18 located in the central portion of the nozzle group form dots as in the case of the above-described full overlap printing. On the other hand, nozzles located at the end portions of the nozzle group (nozzles #1, #2, #19 and #20) form only a half number of dots formed by the nozzles located in the central portion. That is, in this case, the nozzles #1, #2, #19 and #20 are POL nozzles. In addition, as in the case of the above-described full overlap printing, all nozzles (nozzles #1 to #20) eject ink.

In order to carry out the partial overlap printing in the full overlap printing, it is necessary to satisfy the three conditions that (1) the number N'/M is an integer, (2) N'/M is coprime to k, and (3) the carrying amount F is set to (N'/M)·D. Note that, in FIGS. 12A and 12B, the total nozzle number N' is "18".

Note that, in the foregoing full overlap printing, every raster line is formed by two nozzles. On the other hand, in this non-uniform overlap printing, some raster lines are formed by two nozzles, and others by three nozzles. In other words, in the non-uniform overlap printing, the number of nozzles that form raster lines is not uniform for each raster line.

Reference Example: Non-Uniform Overlap Printing 2

Figure 13A:
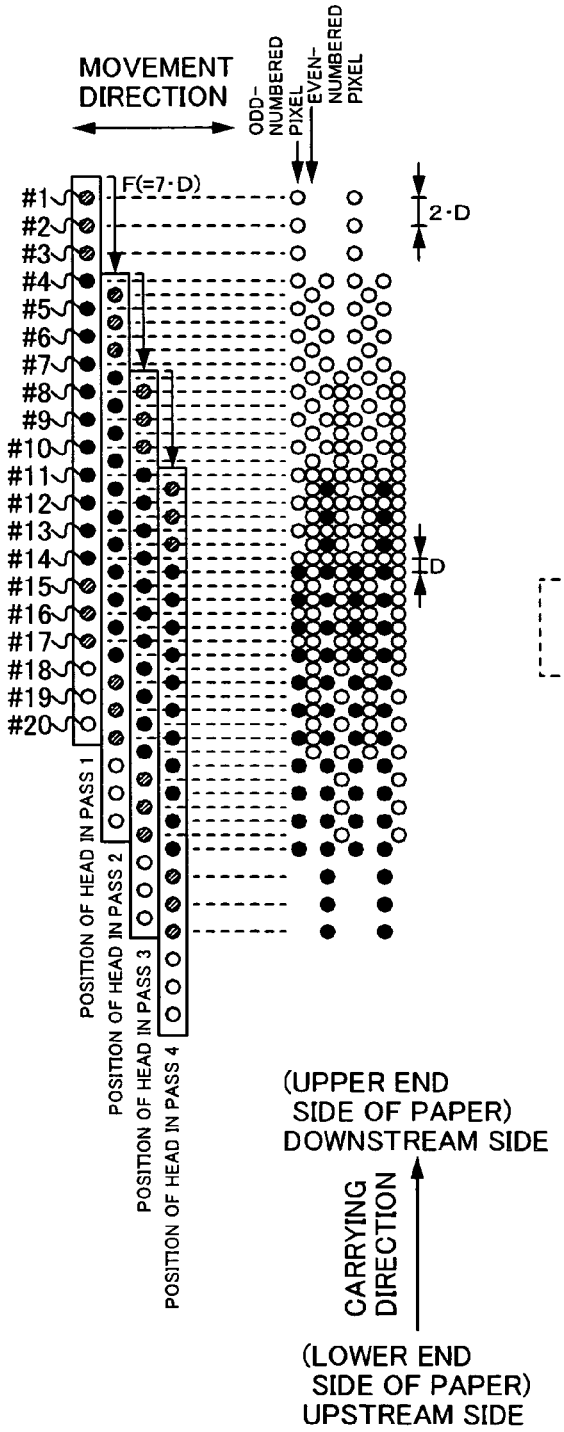
FIG. 13A is an explanatory diagram of another non-uniform overlap printing.
Figure 13B:
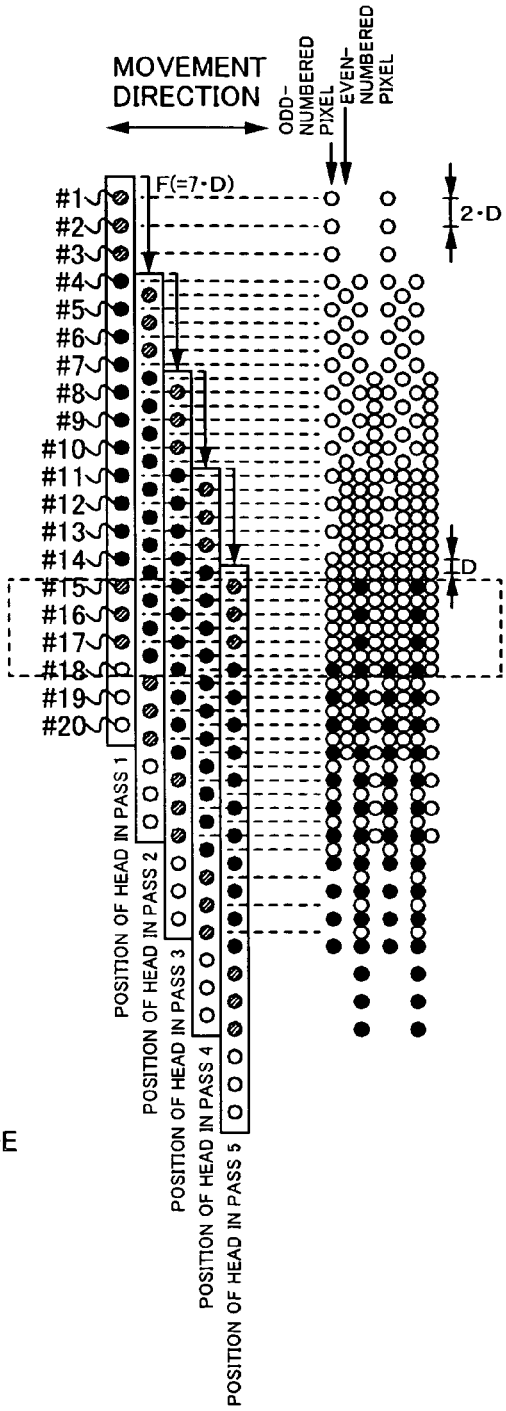
FIG. 13B is an explanatory diagram of another non-uniform overlap printing.

FIGS. 13A and 13B are explanatory diagrams of a different non-uniform overlap printing. FIG. 13A shows the positions of the head and how dots are formed in pass 1 to pass 4, and FIG. 13B shows the positions of the head and how dots are formed in pass 1 to pass 5. In the non-uniform overlap printing in FIGS. 13A and 13B, compared to the non-uniform overlap printing described above in FIGS. 12A and 12B, the total number of nozzles N' is decreased.

In this case, the nozzles #4 to #14 located in the central portion of the nozzle group form dots, as in the case of the above-described full overlap printing. On the other hand, nozzles located at the end portions of the nozzle group (nozzles #1 to #3, and nozzles #15 to #17) form only a half number of dots formed by the nozzles located in the central portion. That is, in this case, the nozzles #1 to #3, and nozzles #15 to #17 are POL nozzles. In addition, as unlike the case of the above-described non-uniform overlap printing, in this non-uniform overlap printing, 17 nozzles (nozzles #1 to #17) eject ink. Further, in the above-described non-uniform overlap printing, the total number of nozzles N' is "18", but in this non-uniform overlap printing the total number of nozzles N' is "14". Note that, since the total number of nozzles N' is decreased, the carry amount F is also decreased from 9·D to 7·D (=(14/2·D).

Figure 14:
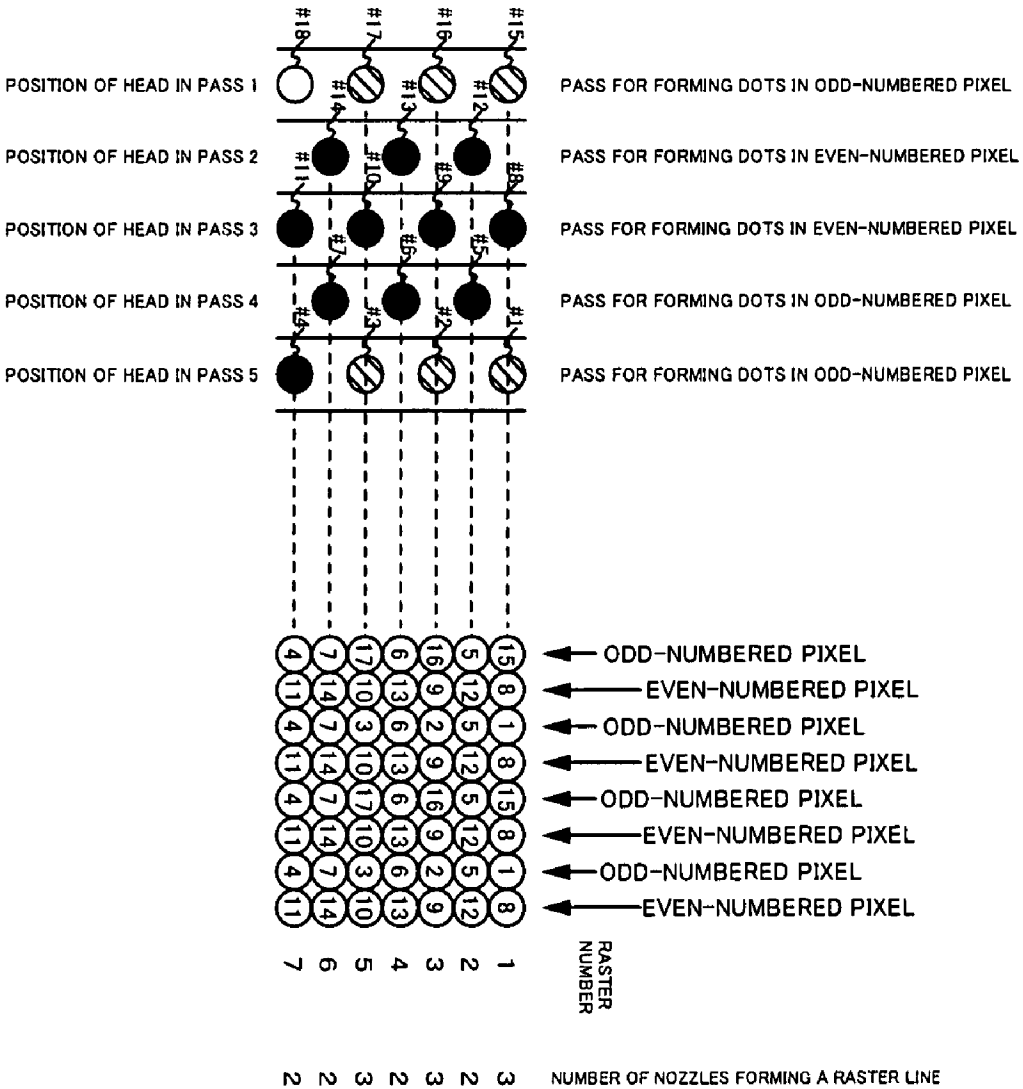
FIG. 14 is an explanatory diagram of how dots are formed in a dotted portion in FIG. 13B.

FIG. 14 is an explanatory diagram of how dots are formed in the region enclosed with the dotted line in FIG. 13B. Of the circles on the left side of the diagram that represent nozzles, the nozzles indicated by hatched circles represent POL nozzles, which forms only a half number of dots formed by the nozzles indicated by solid circle. In each circle on the right side of the diagram that represents a dot, the nozzle number that forms that dot is indicated.

In this non-uniform overlap printing, the second, fourth, sixth, and seventh raster lines are formed by two nozzles. On the other hand, the first, third, and fifth raster lines are formed by three nozzles. In this manner, in the non-uniform overlap printing, the number of nozzles that form a raster line is not uniform according to each raster line.

For example, the second raster line is formed by the nozzle #5 and the nozzle #12. The fourth raster line is formed by the nozzle #6 and the nozzle #13. The sixth raster line is formed by the nozzle #7 and the nozzle #14. The seventh raster line is formed by the nozzle #4 and the nozzle #11. Here, the nozzle #18 does not eject ink. On the other hand, the first raster line is formed by the nozzle#15, the nozzle#8, and the nozzle #1, with the nozzles #15 and #1 functioning as POL nozzles. Further, the third raster line is formed by the nozzles #16, #9 and #2, with the nozzles #16 and #2 functioning as POL nozzles. Further, the fifth raster line is formed by the nozzles

#17, the nozzle #10, and the nozzle #3, with the nozzles #17 and the nozzle #3 functioning as POL nozzles.

Reference Example: Non-uniform Overlap Printing 3

Figure 15A:
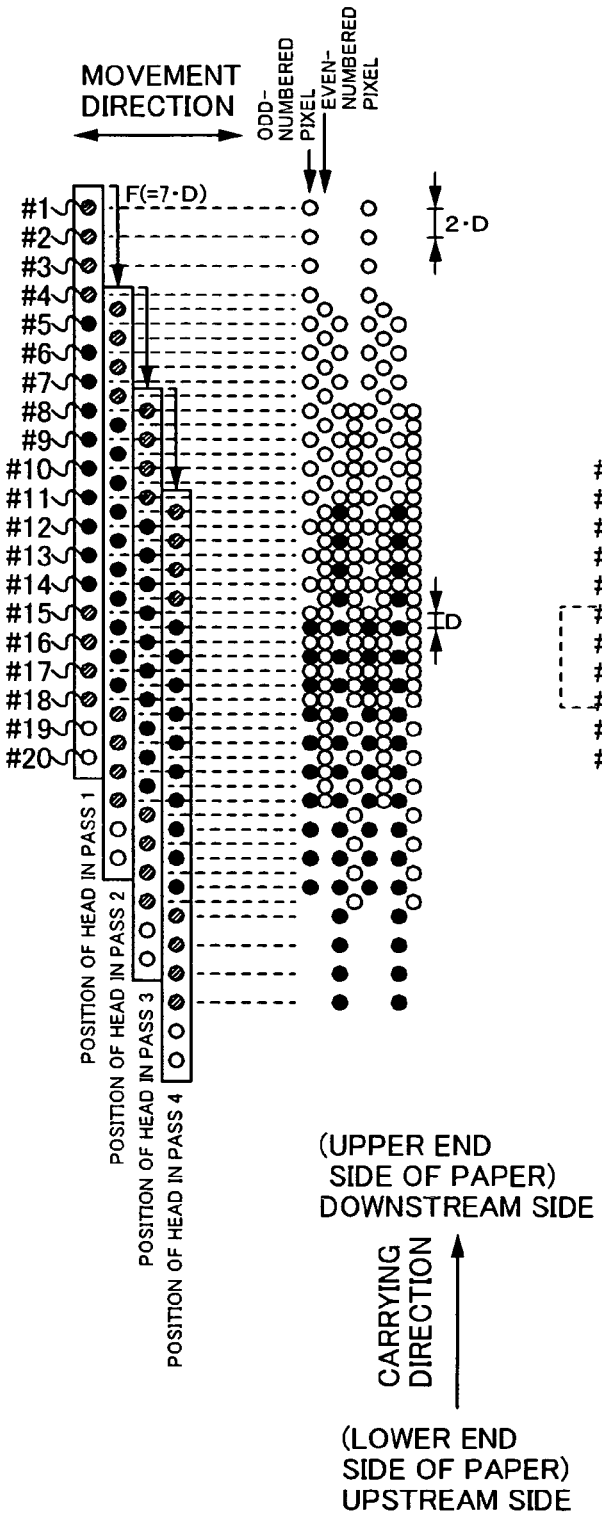
FIG. 15A is an explanatory diagram of further another non-uniform overlap printing.
Figure 15B:
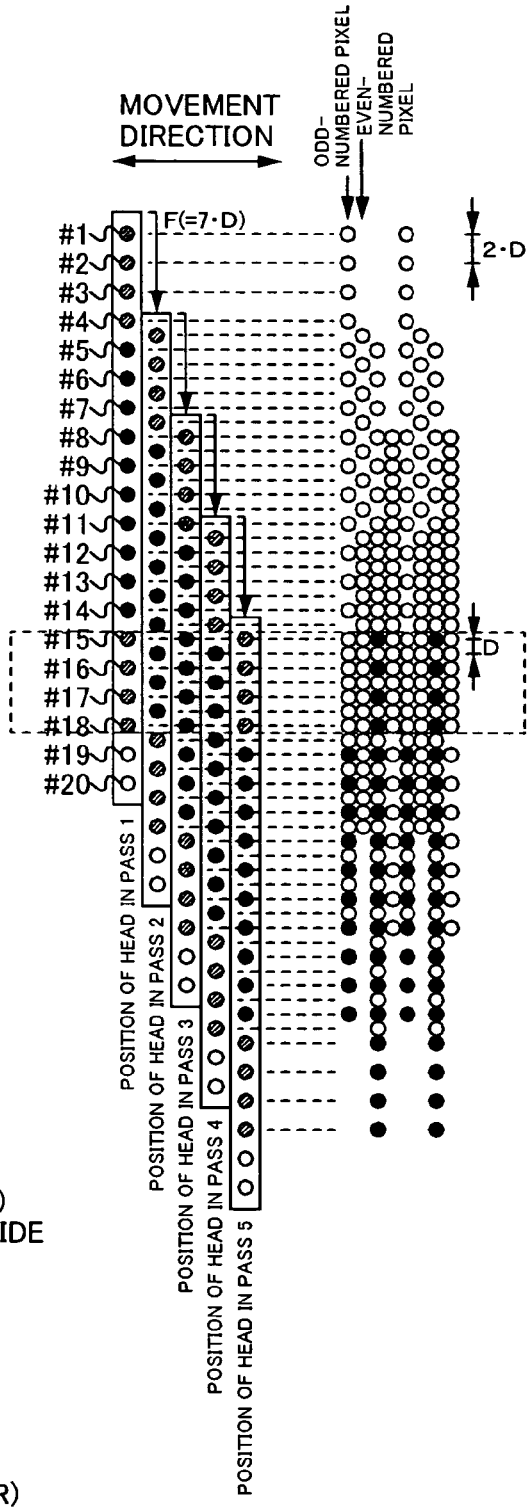
FIG. 15B is an explanatory diagram of further another non-uniform overlap printing.

FIGS. 15A and 15B are explanatory diagrams of another different non-uniform overlap printing. FIG. 15A shows the positions of the head and how dots are formed in pass 1 to pass 4, and FIG. 15B shows the positions of the head and how dots are formed in pass 1 to pass 5. In the non-uniform overlap printing shown in FIGS. 15A and 15B, compared to the non-uniform overlap printing shown in FIGS. 13A and 13B, the number of nozzles that can eject ink is increased, and the number of POL nozzles is increased. However, the non-uniform overlap printing shown in FIGS. 15A and 15B has the same total number N' as the non-uniform overlap printing shown in FIGS. 13A and 13B. Thus, the carrying amount is the same.

In this case, the nozzles #5 to #14 located in the central portion of the nozzle group form dots as in the case of the above-described full overlap printing. On the other hand, nozzles located at the end portions of the nozzle group (nozzles #1 to #4, and nozzles #15 to #18) form only a half number of dots formed by the nozzles located in the central portion. That is, in this case, the nozzles #1 to #4, and the nozzles #15 to #18 are POL nozzles. In addition, as unlike the case of the above-described non-uniform overlap printing, in this non-uniform overlap printing, 18 nozzles (nozzles #1 to #18) eject ink.

Figure 16:
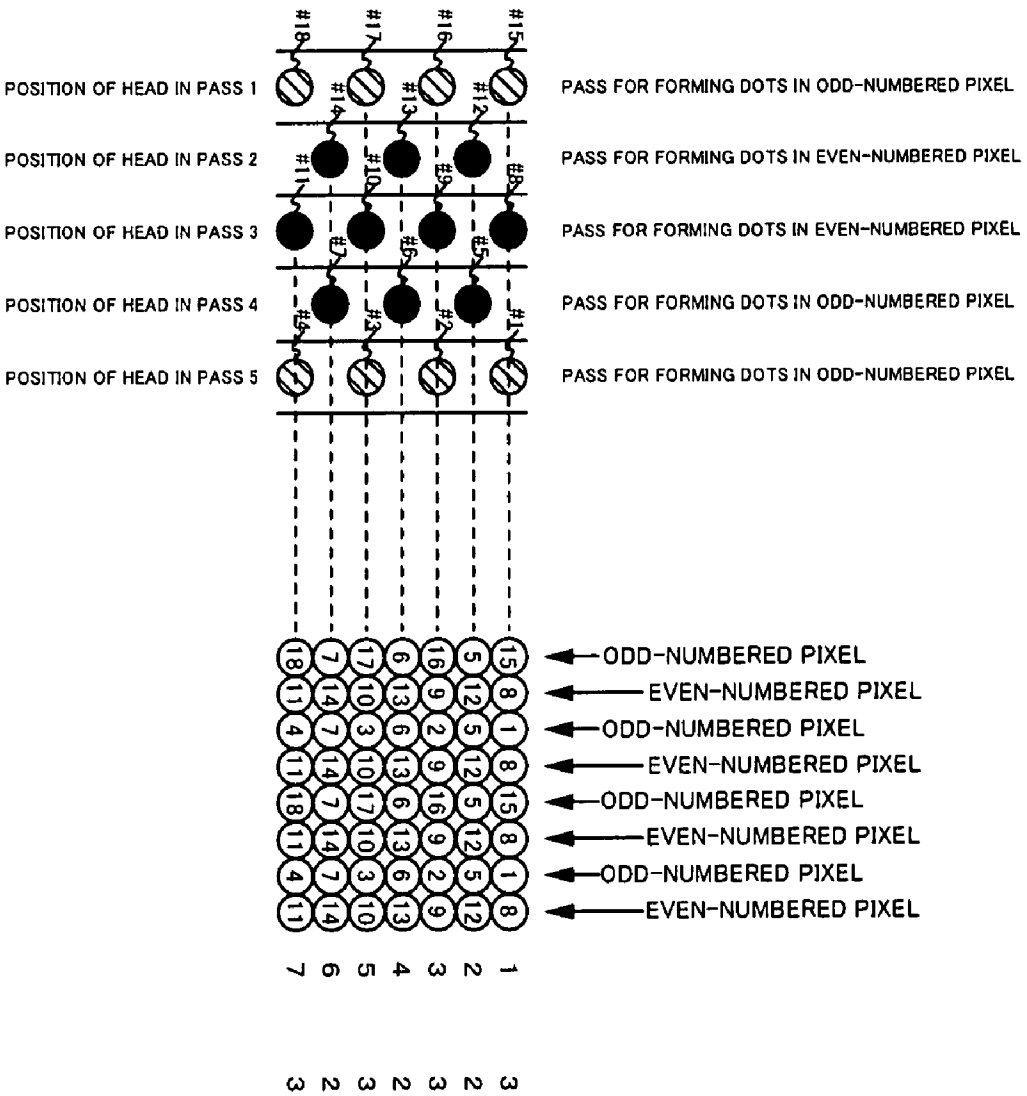
FIG. 16 is an explanatory diagram of how dots are formed in a dotted portion in FIG. 15B.

FIG. 16 is an explanatory diagram of how dots are formed in the region enclosed with the dotted line in FIG. 15B. The nozzles and dots in FIG. 16 are shown as similar to that in FIG. 14, thus explanation is omitted.

In this non-uniform overlap printing, the second, fourth, and sixth raster lines are formed by two nozzles. On the other hand, the first, third, fifth and seventh raster lines are formed by three nozzles.

For example, the second raster line is formed by the nozzle #5 and the nozzle #12. The fourth raster line is formed by the nozzle #6 and the nozzle #13. The sixth raster line is formed by the nozzle #7 and the nozzle #14. On the other hand, the first raster line is formed by the nozzle #15, the nozzle #8, and the nozzle #1, with the nozzles #15 and #1 functioning as POL nozzles. Further, the third raster line is formed by the nozzle #16, the nozzle #9 and the nozzle #2, with the nozzles #16 and #2 functioning as POL nozzles. Further, the fifth raster line is formed by the nozzles #17, the nozzle #10, and the nozzle #3, with the nozzles #17 and the nozzle #3 functioning as POL nozzles. Further, the seventh raster line is formed by the nozzles #18, the nozzle #11, and the nozzle #4, with the nozzles #18 and the nozzle #4 functioning as POL nozzles.

It can be understood by comparing "the number of nozzles that form a raster line" in FIG. 16 and FIG. 14, that the number of the raster lines formed by two nozzles decreases, and the number of raster lines formed by three nozzles increases in the non-uniform overlap printing shown in FIG. 16 than in the non-uniform overlap printing shown in FIG. 14.

Reference Example: Non-uniform Overlap Printing 4

Figure 17A:
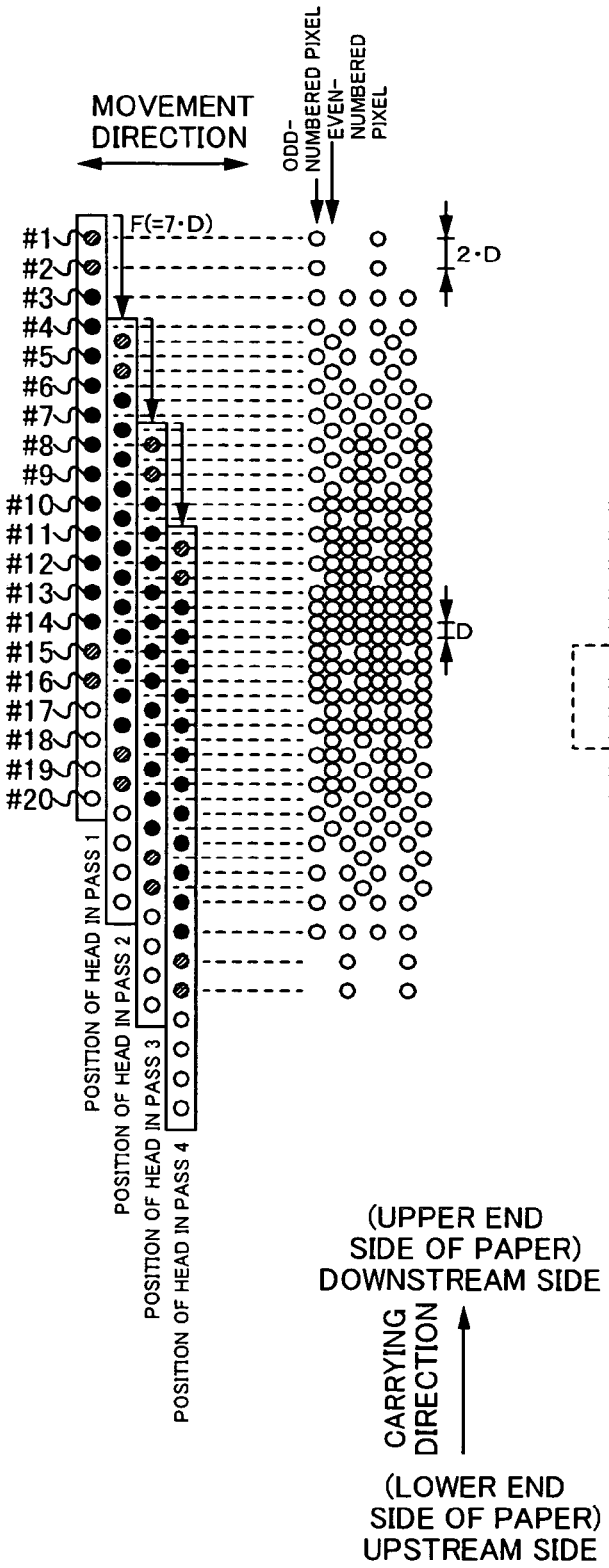
FIG. 17A is an explanatory diagram of further another non-uniform overlap printing.
Figure 17B:
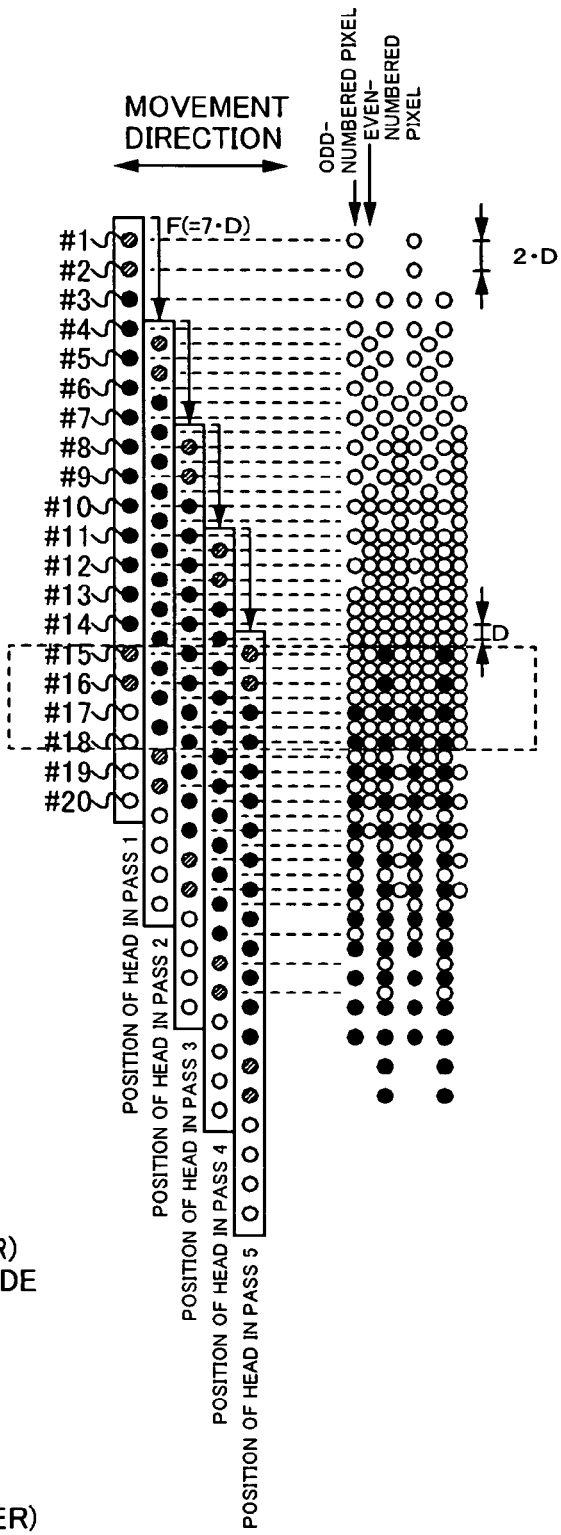
FIG. 17B is an explanatory diagram of further another non-uniform overlap printing.

FIGS. 17A and 17B are explanatory diagrams of a further different non-uniform overlap printing. FIG. 17A shows the positions of the head and how dots are formed in pass 1 to pass 4, and FIG. 17B shows the positions of the head and how dots are formed in pass 1 to pass 5. In the non-uniform overlap printing shown in FIGS. 17A and 17B, the number of nozzles that eject ink is decreased, and the number of POL nozzles is decreased than in the non-uniform overlap printing shown in FIGS. 13A and 13B. However, the non-uniform overlap printing shown in FIGS. 17A and 17B has the same total number N' as the non-uniform overlap printing shown in FIGS. 13A and 13B. Thus, the carrying amount is the same.

In this case, the nozzles #3 to #14 located in the central portion of the nozzle group form dots as in the case of the above-described full overlap printing. On the other hand, nozzles located at the end portions of the nozzle group (nozzle #1, nozzle #2, and nozzle #15, nozzle #16) form only a half number of dots formed by the nozzles located in the central portion. That is, in this case, the nozzle #1, nozzle #2, and nozzle #15, nozzle #16 are POL nozzles. In addition, as unlike the case of the above-described non-uniform overlap printing, in this non-uniform overlap printing, 16 nozzles (nozzles #1 to #16) eject ink.

Figure 18:
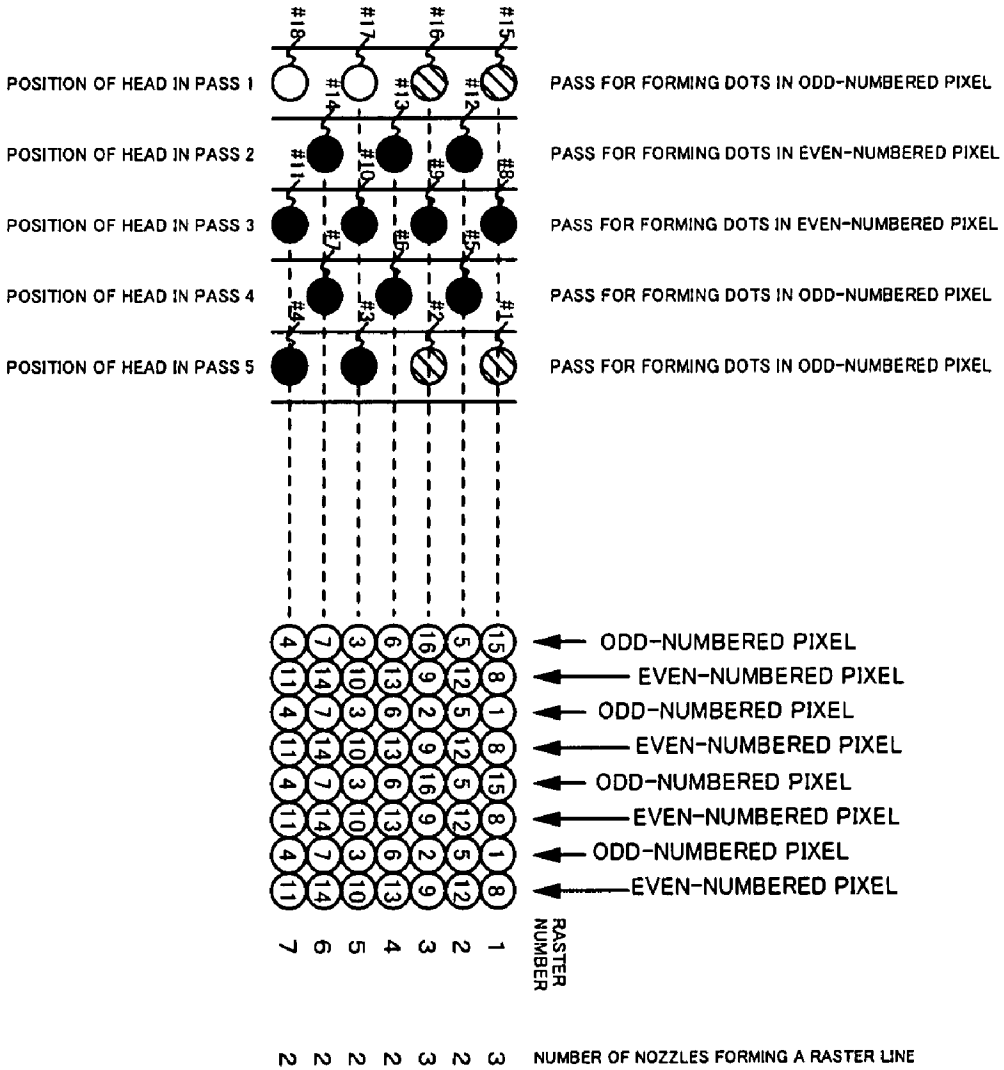
FIG. 18 is an explanatory diagram of how dots are formed in a dotted portion in FIG. 17B.

FIG. 18 is an explanatory diagram of how dots are formed in the region enclosed with the dotted line in FIG. 17B. The nozzles and dots in FIG. 18 are shown as similar to that in FIG. 14, thus explanation is omitted.

In this non-uniform overlap printing, the second, fourth, fifth, sixth, and seventh raster lines are formed by two nozzles. On the other hand, the first and third raster lines are formed by three nozzles.

For example, the second raster line is formed by the nozzle #5 and the nozzle #12. The fourth raster line is formed by the nozzle #6 and the nozzle #13. The fifth raster line is formed by the nozzle #3 and the nozzle #10. The sixth raster line is formed by the nozzle #7 and the nozzle #14. The seventh raster line is formed by the nozzle #4 and the nozzle #11. On the other hand, the first raster line is formed by the nozzle #15, the nozzle #8, and the nozzle #1, with the nozzles #15 and #1 functioning as POL nozzles. Further, the third raster line is formed by the nozzles #16, #9 and #2, with the nozzles #16 and #2 functioning as POL nozzles.

It can be understood by comparing "the number of nozzles that form a raster line" in FIG. 18 and FIG. 14, that the number of the raster line formed by two nozzles increases, and the number of the raster line formed by three nozzles decreases in the non-uniform overlap printing in FIG. 18 than in the non-uniform overlap printing in FIG. 14.

===Regarding Banding that Occurs in Non-uniform Overlap Printing===

Regarding Density Variation Banding

There is the case where the positions of the dots formed by each nozzle, shifts slightly in the paper carrying direction due to a manufacturing error of nozzles.

Figure 19A:
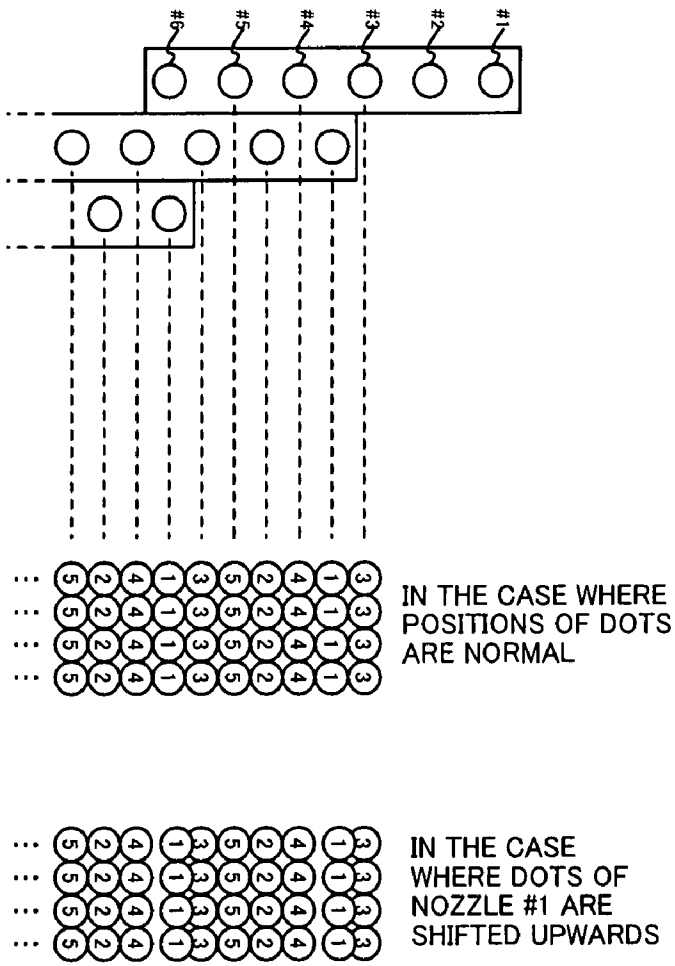
FIG. 19A is an explanatory diagram of positions of dots in the interlace printing.

FIG. 19A is an explanatory diagram of the positions of dots in interlace printing. Here, for convenience of explanation, the number of nozzles is 6 (the number of nozzles that can be used is 5).

On the right side of the diagram, there are shown positions of dots in the case where the dots formed by the nozzle #1 is shifted upwards. As a result of the dots formed by nozzle #1 being shifted upwards, a spacing appears in between the raster line formed by nozzle #1 and a line formed by nozzle #4. When such a spacing is formed, variation in density in the print image occurs, and a stripe pattern is formed in the print image. This stripe shape can be seen as an image quality degradation portion of the print image.

Here, this kind of stripe pattern is called "density variation banding". Note that, the cause of the density variation banding is not only a manufacturing error of the nozzle, but there are several causes such as an error in the paper carrying direction, or a curling of the print medium.

Figure 19B:
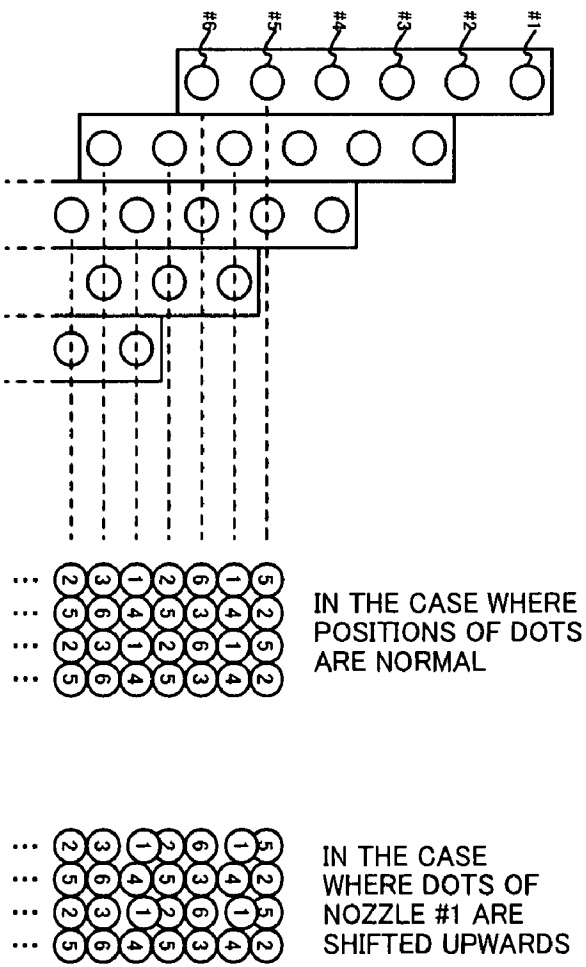
FIG. 19B is an explanatory diagram of positions of dots in the full overlap printing.

FIG. 19B is an explanatory diagram of the positions of the dots in full-overlap printing. Here, for convenience of explanation, the number of nozzles is 6. On the right side of the diagram, there are shown the positions of dots in the case where the dots formed by the nozzle #1 is shifted upwards.

In the case where the number of nozzles that form the raster line is 1 as in the interlace printing, when the positions of the dots shift due to a manufacturing error or the like, the positions of all the dots of the raster line shifts, and the density variation banding becomes conspicuous. However, in the case where the number of nozzles forming a raster line is 2 or more (for example, in the case of full overlap printing or the like), even if a dot formed by a certain nozzle shifts due to a manufacturing error, the positions of all the dots are not shifted, thus it is possible to suppress the density variation banding becoming conspicuous.

That is, the density variation banding is suppressed when the number of nozzles forming the raster line increases.

Regarding Glossy Banding

When printing using pigment ink is performed, color material that floats without dissolving in a solution stays on a surface of the paper and delivers color. However, the pigment ink stays on the surface of the paper so that the state of the surface changes according to the way dots overlap. Then, the gloss of the print image also changes with the influence of the state of the surface of the dot that structures the print image.

In the full overlap printing, the number of nozzles forming a raster line is the same number for any raster line. Further, for any raster line, first, dots are formed at every other dot, and thereafter, dots are formed so as to fill in between the dots. Thus, in the full overlap printing, any raster line is formed so that dots forming the raster line overlap in the same manner. Therefore, in the full-overlap printing, the state of the surface of all the raster lines is in approximately the same state, so that the gloss of the print image becomes uniform.

On the other hand, in the non-uniform overlap printing, depending on the raster line, the number of nozzles used for forming the raster line differs. In other words, in the non-uniform overlap printing, depending on the raster line, the number of passes necessary to complete a raster line differs.

Figure 20A:
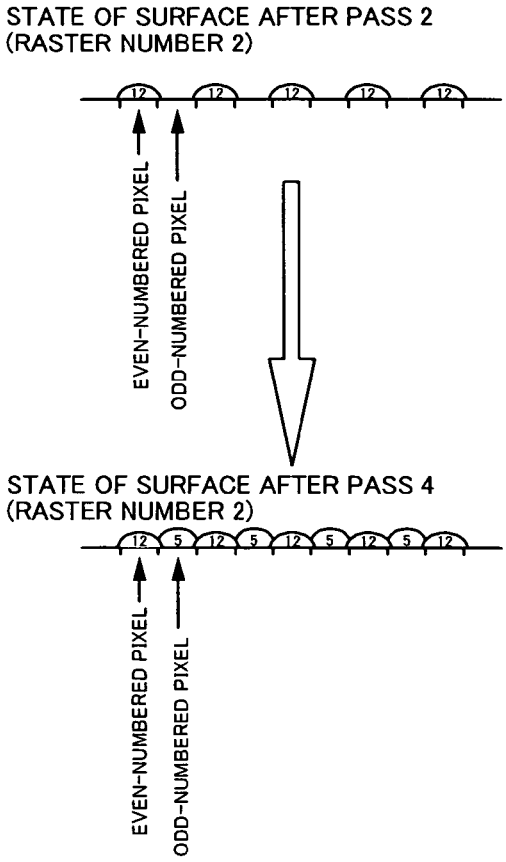
FIG. 20A is an explanatory diagram of how dots overlap in a second raster line shown in FIG. 14.

FIG. 20A is an explanatory view of how dots in the second raster line shown in FIG. 14 overlap each other. In the second raster line, as the raster line in the full overlap printing, the nozzle #12 forms dots at every other dot in pass 2, and thereafter, the nozzle #5 forms dots so as to fill in between the dots in pass 4.

Figure 20B:
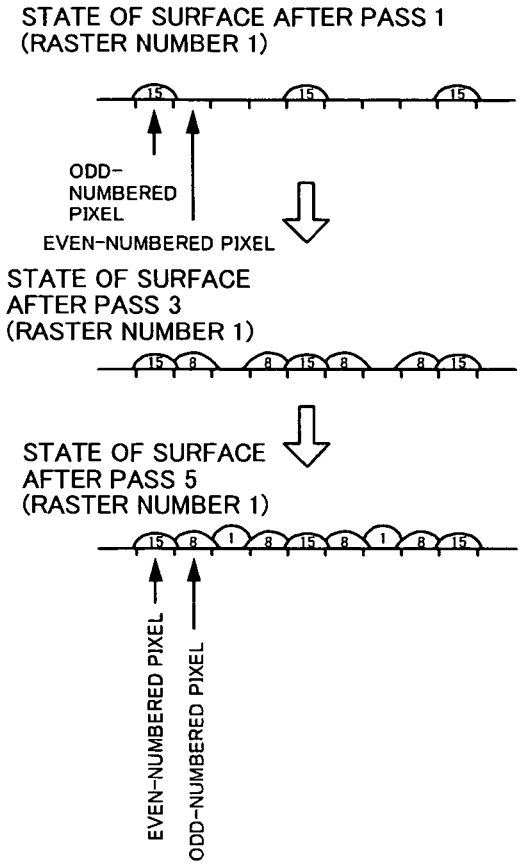
FIG. 20B is an explanatory diagram of how dots overlap in a first raster line shown in FIG. 14.

On the other hand, FIG. 20B is an explanatory diagram of how dots in the first raster line shown in FIG. 14 overlap each other. The first raster line is formed by 3 nozzles, which is different from the second raster line. In the first raster line, in pass 1, the nozzle #15 (POL nozzle) forms dots at a ratio of one pixel to four pixels. Next, in pass 3, the nozzle #8 forms dots at every other dot. Then, in pass 5, the nozzle #1 (POL nozzle) forms dots at a ratio of one pixel to four pixels.

As can be understood by comparing the manner in which dots overlap in the second raster line shown in FIG. 20A to the manner in which dots overlap in the first raster line shown in FIG. 20B, when the manner in which the dots overlap differs, the state of the surface of the raster line differs. Thus, the two raster lines have different gloss.

Then, in the non-uniform overlap printing, depending on the raster line, the number of the nozzles used for forming the raster line differs, so that there are mixed raster lines with different gloss.

Thus, in the print image that has mixed raster lines with different ways in which the dots are ejected and landed, the difference between a region with a uniform gloss and a region with a non-uniform gloss becomes conspicuous. Here, the region that can be visualized with a non-uniform gloss is referred to as "glossy banding".

As in the interlace printing and the full overlap printing, in the case where the number of nozzles forming a raster line is the same for all the raster lines, the glossy banding is inconspicuous. But, in the case where the number of nozzles that form a raster line is different for each raster line as in the non-uniform overlap printing, glossy banding is conspicuous.

Further, in the non-uniform overlap printing, when the number of POL nozzles is large, the number of raster lines formed by 3 nozzles compared to the number of raster lines formed by 2 nozzles is large. Thus, the mixing of the raster lines with different gloss becomes conspicuous, and the glossy banding becomes conspicuous. On the other hand, in the case where the number of POL nozzles is small, the number of raster lines formed by 3 nozzles is smaller than the number of raster lines formed by 2 nozzles, thus glossy banding becomes inconspicuous.

===Embodiment (Outline)===

In the above explanation, there is described a state in which dots are formed for all the pixels. However, the number of dots for a unit area is different according to the density of the print image. For example, in a portion with a high density, within the print image, the number of dots per unit area becomes large. On the other hand, in a portion with a low density, the number of dots per unit area becomes small.

Then, the density variation banding and the glossy banding occur in the non-uniform overlap printing. The way these bandings are conspicuous is different according to the number of the dots configuring the print image.

Relationship Between the Number of Dots and the Occurrence of Density Variation Banding When the number of dots per unit area is large, even if the dots are shifted from a normal position due to an error or the like, since the ink amount that is ejected and landed on the paper is a lot, the ink spreads, and the density variation banding becomes inconspicuous. On the other hand, when the number of dots per unit area is small, if the dots are shifted from the normal positions due to an error or the like, a bias occurs in the density condition of the dots, and the density variation banding becomes conspicuous.

Relationship Between the Number of Dots and the Occurrence of Glossy Banding

As in FIG. 20A and 20B, when the number of the dots per unit area is large, due to the influence of the variation of the manner in which the dots overlap, the surface becomes a different state, and the glossy banding occurs. On the other hand, when the number of dots per unit area is small, the dots are less likely to overlap, so that the glossy banding is not likely to occur.

Conclusion

FIG. 21 shows the degree of conspicuousness of the density variation banding and the glossy banding according to the number of dots per unit area.

When the number of dots per unit area is small, the density variation banding is likely to be conspicuous, but the glossy banding is likely to be inconspicuous.

When the number of dots per unit area is large, the glossy banding is likely to be conspicuous, but density variation banding is likely to be inconspicuous.

That is, when the number dots per unit area is small, the density variation banding becomes conspicuous, and the glossy banding becomes inconspicuous. Then, when the amount of the number of the dots per unit area is large, the glossy banding becomes conspicuous, and the density variation banding becomes inconspicuous. Thus, according to the number of dots, the type of banding that becomes conspicuous differs.

Thus, in this embodiment, a printing mode is determined according to the number of dots per unit area.

Printing Mode according to the Number of Dots per Unit Area

FIG. 22 shows a printing mode of this embodiment that is used according to the number of dots per unit area.

As shown in FIG. 22, when the number of dots per unit area is large, the glossy banding becomes more likely to occur. Thus, in this embodiment, a printing mode is used for decreasing the non-uniformity of gloss by decreasing the number of POL nozzles and increasing the dot rows having a small number of nozzles forming the dot row.

Further, as shown in FIG. 22, when the number of dots per unit area is small, the density variation banding is likely to occur. Thus, in this embodiment, a printing mode is used for reducing a spacing formed between dot rows, by increasing the number of POL nozzles and increasing the number of the dot rows having a large number of nozzles forming the dot row.

===Regarding the Process of the Printer Driver in this Embodiment===

Figure 23:
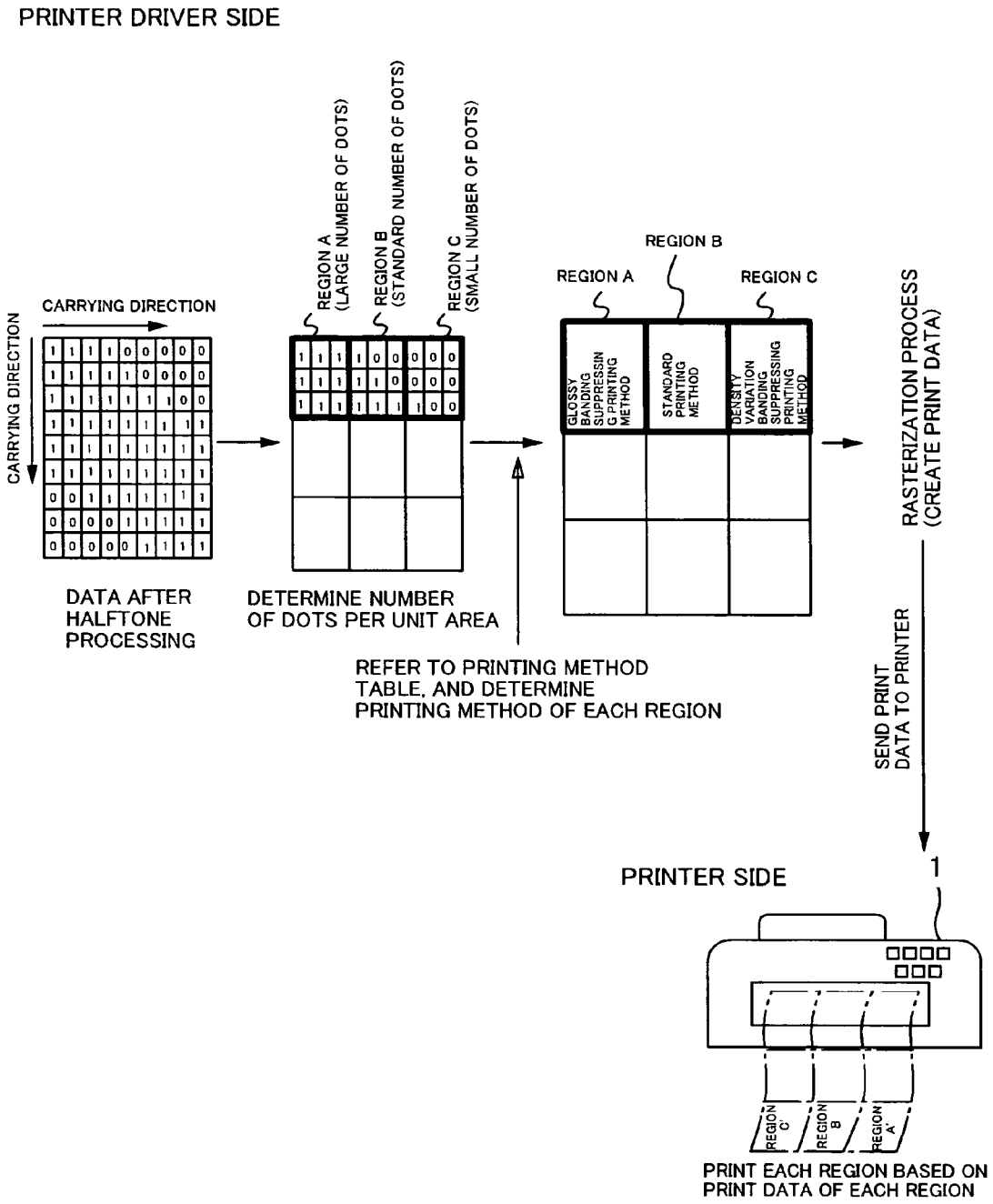
FIG. 23 is an explanatory diagram showing simply an operation at the printer driver side and the printer side in this embodiment.

FIG. 23 is an explanatory diagram simply showing operations at the printer driver side and the printer side in this embodiment. In this embodiment, at the printer driver side, image data formed of pixel data in 256 gradations undergoes the halftone process, and the image data formed of pixel data of binary data is created. The pixel data that has undergone the halftone process is configured by one bit data for each pixel. Each of the pixel data is 0 or 1, a dot is not formed for the pixel that has the pixel data of 0, and a dot is formed for the pixel that has the pixel data of 1. In the diagram in the left upper side of FIG. 23, the pixels are shown as squares, and in each square, there is shown a pixel data of the pixel that corresponds to the square. Note that, for convenience of explanation, the number of pixels in the figure is greatly decreased than in the actual case.

After the pixel data undergoes the halftone process, the printer driver divides the image data, and divides the print range into a plurality of regions. As shown in the second figure from the left upper side in FIG. 23, at the printer driver side, the image data is divided into, for example, nine regions. However, the number that the printer driver divides the print range of the medium into, is not limited to nine. For example, as described below, it is possible to not divide the print range, so that the entire print range is the predetermined region.

Here, at the time of dividing the image data, the printer driver divides the image data according to the program. For example, the printer driver divides the image data into three regions longitudinally so as to arrange the divided regions along the carrying direction, according to the setting of the program. Further, the printer driver divides the image data into three regions horizontally so as to arrange the divided regions along the carrying direction, according to the setting of the program. The dividing position is also determined by the setting of the program. Here, by dividing into three sections in the movement direction and the carrying direction, the image data is divided into nine sections. Note that, in FIG. 23, the three regions in the upper part of the print region are referred to as region A, region B, and region C.

Next, the printer driver counts the pixels with the pixel data of 1 in each region, and determines the number of dots in each region. In the case where there are a lot of pixels with the pixel data of 1 in a certain region, this means that a lot of dots are formed on the positions on the medium corresponding to that region. On the other hand, in the case where there are a few pixels with the pixel data of 1 in a certain region, this means that not many dots are formed in the positions on the medium corresponding to this region. Then, in the case where the pixels with the pixel data of 1 is more than a predetermined threshold X, the printer driver determines that there are many dots to be formed in that region. On the other hand, in the case where pixels with the pixel data of 1 is less than a predetermined threshold Y, the printer driver determines that the dots to be formed in that region is a few. As shown in FIG. 23, it is determined that the number of dots is large in the region A, it is determined that the number of dots is standard in the region B, and it is determined that the number of dots is small in the region C.

Table of Printing Modes in this Embodiment

When the number of the dots in each region is determined, the printer driver refers to a table of printing modes of this embodiment.

FIG. 24 is a table showing a plurality of the printing modes of this embodiment that are selected by the printer driver according to the number of dots per unit area. As shown in this figure, in the table, the number of dots per unit area and the printing modes are corresponded to each other. Note that, in the right side of the figure, for reference, the number of POL nozzles to be used in each of the printing modes is shown.

When the number of dots per unit area is standard, a standard non-uniform overlap printing mode (hereinbelow, referred to as "standard printing mode") is selected. The standard printing mode is a printing mode that is similar to the non-uniform overlap printing 2 in the reference example shown in FIG. 13A and FIG. 13B, and 17 nozzles eject ink. Of the 17 nozzles that eject ink, 6 nozzles are the POL nozzles.

Further, when the amount of dots per unit area is larger than the standard, the printing mode that can suppress the glossy banding (hereinafter, referred to as "glossy banding suppressing printing mode") is selected. The glossy banding suppressing printing mode is the printing mode similar to the non-uniform overlap printing 4 in the reference example shown in FIG. 17A and FIG. 17B, and 16 nozzles eject ink. Of the 16 nozzles that eject ink, 4 nozzles are the POL nozzles.

When the number of the dots per unit area is small, the printing mode that can suppress the density variation banding (hereinbelow, referred to as "density variation banding suppressing printing mode") is selected. The density variation banding suppressing printing mode is the printing mode similar to the non-uniform overlap printing 3 in the reference example shown in FIG. 15A and FIG. 15B, and 18 nozzles eject ink. Of the 18 nozzles that eject ink, eight nozzles are the POL nozzles.

In this embodiment, the printing mode that is selected according to the number of dots per unit area is set in advance at the printer driver side.

Determination of the Number of POL Nozzles

As described above, the printer driver determines the amount of the number of dots in each region, refers to the table of the printing mode, and determines for each region the printing mode selected according to the number of the dots.

As shown in the right upper figure in FIG. 23, for the region A with a large number of the dots, the glossy banding suppressing printing mode is selected. Further, for the region B with a standard number of dots, the standard printing mode is selected. Further, for the region C with a small number of dots, the density variation suppressing printing mode is selected. Thus, the printing mode that is appropriate for each region is determined.

When the printing mode for each region is determined, the number of nozzles that eject ink in the dot forming process and the number of POL nozzles are determined.

Rasterization Process

When the printing mode for each region is determined, it is possible to determine to which nozzle of which pass each pixel is corresponded to. In other words, when the printing mode for each region is determined, it is possible to determine to which pixel each nozzle in each pass is corresponded to. Thus, since the printing mode for each region is determined, the printer driver can extract the pixel data corresponding to each nozzle in each pass, and can form data showing the ejection state of ink of each nozzle in each pass.

The data extracted in this way is included in the print data and sent to the printer side.

Regarding the Process of the Printer in this Embodiment

Based on the print data sent from the printer driver side, at the printer side each region is printed by each printing mode. In a region A' on the medium, the image shown in the region A of the image data is printed. In a region B' on the medium, the image shown in the region B of the image data is printed. Further, in a region C' on the medium, the image shown in the region C of the image data is printed. Then, printing is performed by the glossy banding suppressing printing mode in the region A' on the medium, printing is performed by the standard printing mode in the region B', and printing is performed by the density variation suppressing printing mode in the region C'.

Figure 25:
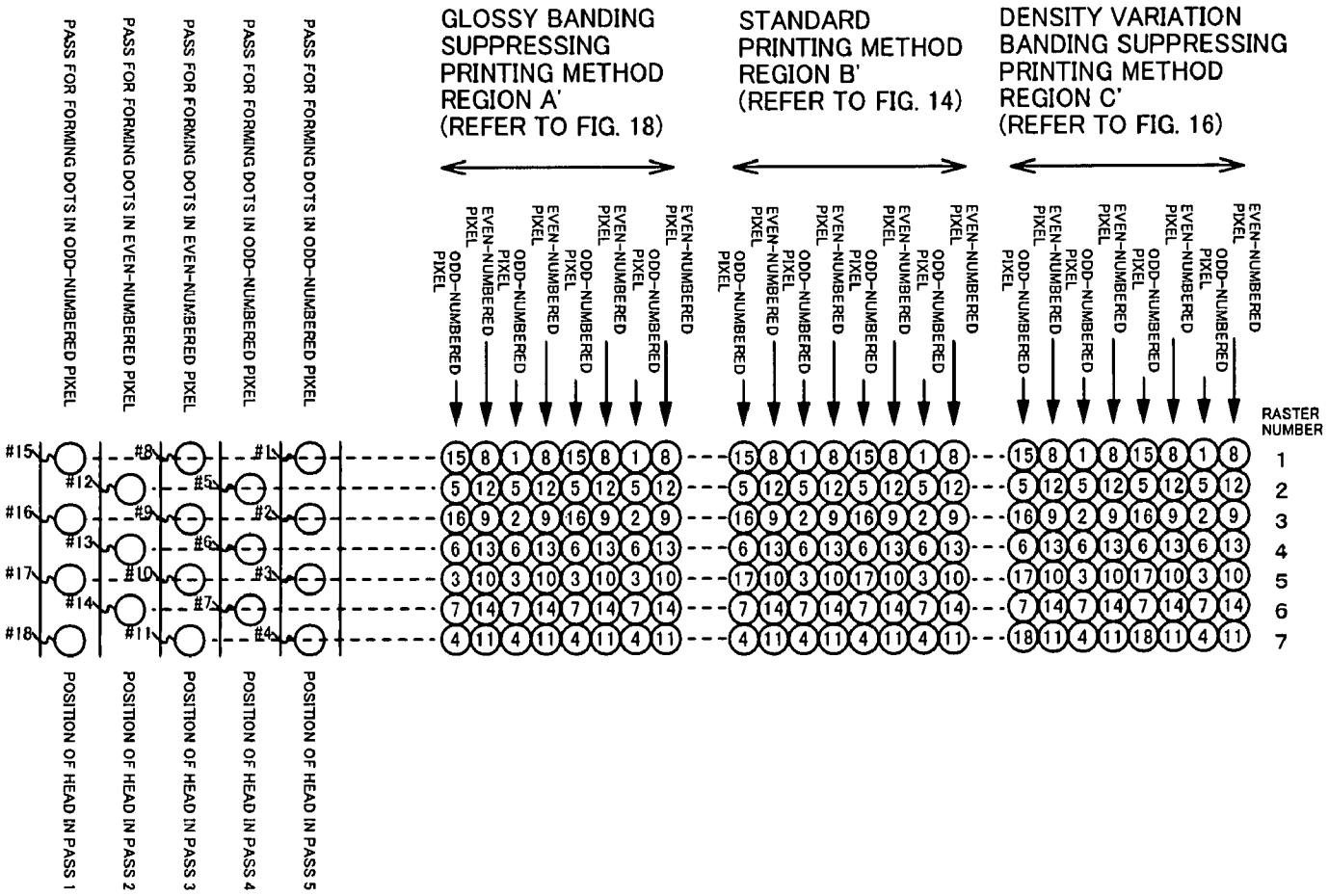
FIG. 25 is an explanatory diagram of a manner of a dot forming process in a glossy banding suppressing printing mode, a standard printing mode, and a density variation banding suppressing printing mode.

FIG. 25 is an explanatory diagram of the manner of the dot forming process by the glossy banding suppressing printing mode, the standard printing mode, and the density variation banding suppressing method. On the left side in the figure, there are circles showing the nozzles, and on the right side in the figure, there are circles showing dots that are filled in with a number of the nozzle that forms the dot. Note that, for convenience of explanation, dots are to be formed for all the pixels, but dots are not formed for the pixels with the pixel data of 0. In particular, in the region C', there are a lot of pixels with the pixel data of 0, thus in reality there should be a lot of pixels in which a dot is not formed.

Here, paying attention to the second, fourth, and sixth raster lines, they are formed by two nozzles in all regions. That is, these raster lines are formed in the same way as in the full overlap printing.

On the other hand, paying attention to the fifth raster line, the region A' is formed by the glossy banding suppressing printing mode by two nozzles, but the region B' and the region C' are formed by the standard printing mode and the density variation suppressing printing mode by three nozzles. Specifically, when the fifth raster line is formed, the nozzle #17 does not eject ink in the region A', but in the region B' and the region C' ink is ejected at a ratio of one pixel to four pixels. Further, the nozzle #3 ejects ink in the region A' at a ratio of one pixel to two pixels, but ejects ink in the region B' and the region C' at a ratio of one pixel to four pixels. Thus, in the region A', the number of raster lines that are formed by three nozzles is smaller than in the region B' or the region C'.

Further, paying attention to the seventh raster line, it is formed by two nozzles in the glossy banding suppressing printing mode and the standard printing mode, but it is formed by three nozzles in the density variation banding suppressing printing mode. In other words, the number of nozzles forming the raster line is larger in the density variation banding suppressing printing mode than the glossy banding suppressing printing mode and the standard printing mode. More specifically, when forming the seventh raster line, the nozzle #18 does not eject ink in the region A' and the region B', but ejects ink at a ratio of one pixel to four pixels in the region C', and the nozzle #4 ejects ink at a ratio of one pixel to two pixels in the region A' and the region B', and ejects ink at a ratio of one pixel to four pixels in the region C'. Thus, in the region C', there is a larger number of raster lines formed by three nozzles than in the region A' and the region B'.

As shown in FIG. 25, in the glossy banding suppressing printing mode, the rasters 1 and 3 are formed by three nozzles, and in the density variation banding suppressing printing mode, the rasters 1, 3, 5, and 7 are formed by three nozzles. That is, the ratio of the number of raster lines formed by three nozzles compared to the number of raster lines formed by two nozzles is small in the glossy banding suppressing printing mode, and the ratio is large in the density variation banding suppressing printing mode.

As shown in FIG. 25, by selecting the glossy banding suppressing printing mode for the region A with a large number of dots in which the glossy banding is conspicuous, the region A' can be printed by suppressing the glossy banding. On the other hand, in the region A the number of dots is large so that even if the glossy banding suppressing printing mode is selected, the density variation banding is inconspicuous.

Further, by selecting the density variation banding suppressing printing mode in the region C with a small number of dots in which the density variation banding is conspicuous, the region C' can be printed by suppressing the density variation banding. On the other hand, in the region C the number of dots is small, so that even if the density variation suppressing printing mode is selected, the glossy banding is inconspicuous.

That is, by selecting the printing mode according to the number of dots in each region, each region can be printed by suppressing the glossy banding and the density variation banding. Then, by suppressing the glossy banding and the density variation banding in each region, the glossy banding and the density variation banding in the entire print range can be suppressed.

In this embodiment, the carrying amount F of each of the glossy banding suppressing printing mode (refer to FIG. 17A and FIG. 17B), the standard printing mode (refer to FIG. 13A and 13B), and the density variation banding suppressing printing mode (refer to FIG. 15A and FIG. 15B) is 7·D and is common for them all. Thus, the position of the head in respect to the paper in each pass is common for any of the printing modes. Thus, it is possible to switch the printing modes in the same pass.

In this embodiment, each region is printed by the printing mode according to the number of dots in each region (such as the region A') on the medium that has been divided into nine sections. Thus, the dark region A with a large number of dots is printed by the glossy banding suppressing printing mode, the region B with the standard number of dots is printed by the standard printing mode, and the light region C with a small number of dots is printed with the density variation banding suppressing printing mode. Thus, each region can be printed with an appropriate printing mode.

In this embodiment, the controller makes the print range to be divided so as to be arranged along the movement direction of the carriage, and forms each region. Thus, even if the image is such that the variation in density changes along the movement direction, an appropriate printing mode according to the variation in density (according to the number of dots) can be selected, and each region can be printed appropriately.

In this embodiment, the controller makes the print range to be divided so as to be arranged along the carrying direction of the paper, and forms each region. Thus, even if the image is such that the variation in density changes along the carrying direction, an appropriate printing mode according to the variation in density (according to the number of dots) can be selected, and each region can be printed appropriately.

In this embodiment, the number of nozzles that can eject ink in the glossy banding suppressing printing mode (refer to FIGS. 17A and FIG. 17B) is 16, the number of nozzles that can eject ink in the standard-printing mode (refer to FIG. 13A and FIG. 13B) is 17, and the number of nozzles that can eject ink in the density variation banding suppressing printing mode (refer to FIG. 15A and FIG. 15B) is 18. Thus, the number of POL nozzles in the glossy banding suppressing printing mode is 4, the number of POL nozzles in the standard printing mode is 6, and the number of POL nozzles in the density variation banding suppressing printing mode is 8. Therefore, in each printing mode, a ratio of the number of the raster line formed by three nozzles to the number of the raster line formed by two nozzles differs.

In the dark region (the region with a large number of dots), it is more likely for the dots to overlap, so that non-uniformity of gloss becomes conspicuous. In this embodiment, in respect to such region, printing is performed by the glossy banding suppressing printing mode which can suppress the glossy banding. Therefore, it is possible to make the glossy banding inconspicuous.

In the light region (the region with a small number of dots), it is less likely for the dots to overlap, so that the density variation banding becomes conspicuous. In this embodiment, in respect to such a region, printing is performed by the density variation banding suppressing printing mode which can suppress the density variation banding. Therefore, it is possible to make the density variation banding inconspicuous.

In this embodiment, when comparing the standard printing mode and the glossy banding suppressing printing mode, the glossy banding suppressing printing mode has a smaller number of nozzles that can eject ink. Therefore, the ratio of the number of raster lines formed by three nozzles to the number of raster lines formed by two nozzles becomes smaller (refer to FIG. 25). Therefore, in the glossy banding suppressing printing mode, there are less raster lines formed by three nozzles, and the glossy banding can be suppressed.

In this embodiment, when comparing the standard printing mode and the density variation suppressing printing mode, the density variation banding suppressing printing mode has a larger number of nozzles that can eject ink. Therefore, the ratio of the number of raster lines formed by three nozzles to the number of raster lines formed by two nozzles becomes larger (refer to FIG. 25). Therefore, in the density variation banding suppressing printing mode, there are more raster lines formed by three nozzles, and the density variation banding can be suppressed.

In this embodiment, printing is performed by pigment ink in any of the printing modes. Normally, when pigment ink is used, depending on the order that the dots overlap, the glossy banding becomes more likely to occur. But in this embodiment, it is possible to print by suppressing the glossy banding.

According to the printing system including all the above-described structural elements, all the effects can be realized, and thus it is preferable. However, it is not necessary to include all of the structural elements. In short, it is preferable as long as it is a structure in which the printing mode can be selected according to the number of dots of a certain region, and the glossy banding and the density variation banding can be suppressed.

===Other Embodiments===

The above embodiment is to facilitate the understanding of this invention, and is not for limiting the understanding of this invention. This invention can be changed or modified without departing from its scope, and it is needless to say that it includes its functional equivalents.

In particular, this invention includes the following configuration.

Regarding Setting of the Region

In the above-described embodiment, the printer driver divides the print range of the medium into a plurality of regions. But, it is possible to have the entire print range as the predetermined region, without dividing the print range of the medium.

Figure 26:
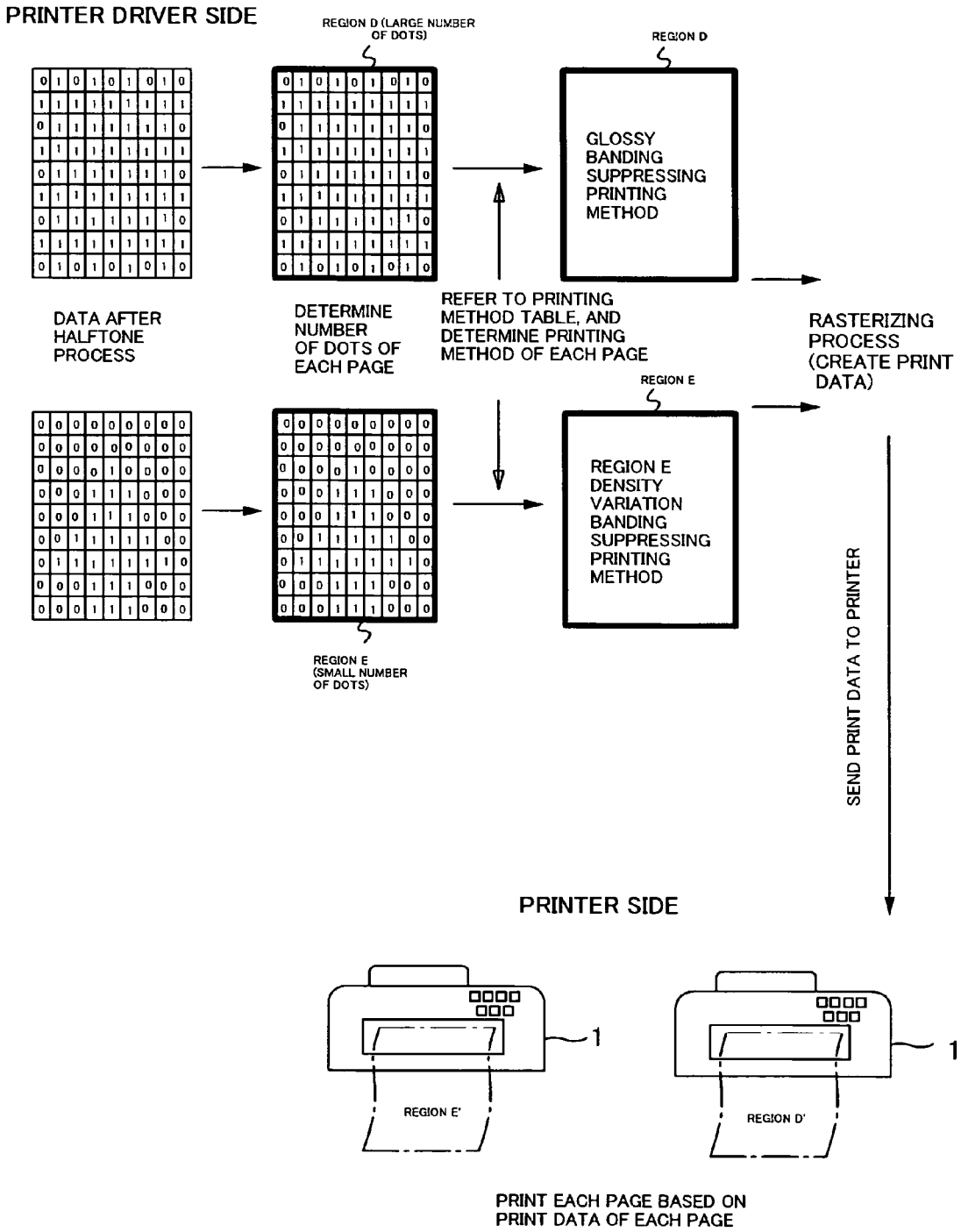
FIG. 26 is an explanatory diagram showing simply operations at the printer driver side and the printer side in another embodiment.

FIG. 26 is an explanatory diagram showing simply the operations at the printer driver side and the printer side in another embodiment. In FIG. 26, the entire print range in the diagrams at the upper side is called a region D, and the entire print range of the diagrams at the lower side is called a region E. The printer driver determines the number of dots of the region D and the region E. Then, the printer driver refers to the table of the printing modes, and determines the printing mode to be selected according to the number of the dots.

Since the number of dots in the region D is large, the glossy banding suppressing printing mode is selected. Further, since the number of dots is small in the region E, the density variation banding suppressing printing mode is selected.

Then, after the rasterization process of the image data, the print data that is created is sent to the printer side. At the printer side, the region of the entire print range is printed by the selected printing mode. Thus, the region of the entire print range can be printed by suppressing the glossy banding and the density variation banding.

In this embodiment, the printing of the region is performed by the printing mode according to the number of the dots of the region of the entire paper (such as the region D'). Therefore, the dark region D with a large number of dots can be printed with the glossy banding suppressing printing mode, and the light region E with a small number of dots can be printed with the density variation banding suppressing printing mode. Therefore, each paper can be printed with an appropriate printing mode.

Note that, in the above-described embodiment, the image data is divided so that the divided regions are arranged along the movement direction, and further the image data is divided so that the divided regions are arranged along the carrying direction. In other words, in the above-described embodiment, the image data is divided in any of the directions of the movement direction and the carrying direction. However, the image data can be divided so that the divided regions are arranged in only one of the directions. That is, the regions can be divided so as to be arranged along only the movement direction, and the regions can be divided so as to be arranged along only the carrying direction.

Regarding Positions of Dividing Regions

In the above-described embodiment, a boundary for dividing the regions is in the same position in all of the raster lines, and the boundary is a straight line. However, this is not a limitation. In the case where the boundary of the regions is a straight line, the printing mode is changed at the boundary in the same positions in all the raster lines in the regions. Thus, there is a possibility that the boundary at which the printing mode changes is conspicuous. The boundary can be set at different positions for every raster line.

For example, the boundary can be shifted slightly for every raster line, and the regions can be divided in a zigzag. Thus, compared to the case where the boundary for dividing the regions is a straight line, the boundary portion becomes inconspicuous.

Further, the boundary can be shifted irregularly for every raster line, and the regions can be divided randomly. Thus, the boundary for dividing the regions becomes irregular, and it is harder to visualize the boundary portion.

Further, it is possible that an edge of the image is detected, the edge is set as a boundary, and the regions are divided at the edge. Thus, the positions at which the printing mode is changed becomes not only inconspicuous, but also it is possible to print each portion of the image in a printing mode in accordance with the density of the image.

Regarding the Dot

In the above-described embodiment, all the sizes of the dots to be formed were the same. However, this is not a limitation. It is possible to selectively form a large dot, a medium dot, and a small dot. In this case, it is preferable that the dots are weighted according to the size of the dot, and the number of the dots is calculated. Thus, a printing mode can be selected according to the number of the dots measured in consideration of the size of the dots, and a printing mode appropriate for the printing image can be selected.

What is claimed is:

1. A printing method comprising:

printing an image to be printed on a medium by repeating alternately a dot forming process for forming dots on the medium by ejecting ink from each nozzle of a plurality of nozzles, and a carrying process for carrying the medium in a carrying direction, and forming a plurality of rows of dots, lined up in the carrying direction, that are configured by a plurality of dots lined up in a movement direction;

counting a number of dots to be formed in a certain region of the medium;

selecting a printing mode according to the number of the dots, from among a plurality of the printing modes each with a different ratio of the number of dot rows formed using a different number of nozzles to the number of dot rows formed using a certain number of nozzles, the different number of nozzles being larger than the certain number of nozzles; and printing on the certain region to be printed based on the selected printing mode, wherein:

the printing modes comprise a first printing mode and a second printing mode, the first printing mode has a first ratio as the different ratio of the number of dot rows, the second printing mode has a second ratio as the different ratio of the number of dot rows, the second ratio being larger than the first ratio, if the number of the dots to be formed in the certain region is larger than a threshold, the first printing mode is selected, and if the number of the dots to be formed in the certain region is smaller than the threshold, the second printing mode is selected.

2. printing method according to claim 1, wherein in the carrying process of each of a plurality of the printing modes, the medium is carried with a predetermined carrying amount in the carrying direction.

3. A printing method according to claim 1, wherein a print range of the medium is divided into a plurality of regions, and the certain region is one of the regions.

4. printing method according to claim 3, wherein the print range is divided so as to arrange the divided regions along the movement direction.

5. printing method according to claim 3, wherein the print range is divided so as to arrange the divided regions along the carrying direction.

6. A printing method according to claim 1, wherein the certain region is an entire region of the print range of the medium.

7. A printing method according to claim 1, wherein in the printing mode with a smaller number of the nozzles that can eject ink at the time of the dot forming process, a ratio of the number of the dot rows formed using a large number of the nozzles to the number of the dot rows formed using a small number of the nozzles becomes smaller.

8. A printing method according to claim 1, wherein the printing mode with a large number of the nozzles that can eject at the time of the dot forming process is selected, when the number of the dots in the certain region is small.

9. A printing method according to claim 8, wherein in the printing mode with a larger number of the nozzles that can eject ink at the time of the dot forming process, a ratio of the number of the dot rows formed using a large number of the nozzles to the number of the dot rows formed using a small number of the nozzles becomes larger.

10. A printing method according to claim 1, wherein the ink is pigment ink.

11. A printing method comprising:

printing an image to be printed on a medium by repeating alternately a dot forming process for forming dots on the medium by ejecting ink from each nozzle of a plurality of nozzles, and a carrying process for carrying the medium in a carrying direction, and forming a plurality of rows of dots, lined up in the carrying direction, that are configured by a plurality of dots lined up in a movement direction;

counting a number of dots to be formed in a certain region of the medium;

selecting a printing mode according to the number of the dots, from among a plurality of the printing modes each with a different ratio of the number of dot rows formed using a different number of nozzles to the number of dot rows formed using a certain number of nozzles, the different number of nozzles being larger than the certain number of nozzles; and printing on the certain region to be printed based on the selected printing mode, wherein:

the printing modes comprise a first printing mode and a second printing mode, the first printing mode has a first ratio as the different ratio of the number of dot rows, the second printing mode has a second ratio as the different ratio of the number of dot rows, the second ratio being larger than the first ratio, if the number of the dots to be formed in the certain region is larger than a threshold, the first printing mode is selected, and if the number of the dots to be formed in the certain region is smaller than the threshold, the second printing mode is selected, in the carrying process of each of a plurality of the printing modes, the medium is carried with a predetermined carrying amount in the carrying direction, a print range of the medium is divided into a plurality of regions, and the certain region is one of the regions, the print range is divided so as to arrange the divided regions along the movement direction, the print range is divided so as to arrange the divided regions along the carrying direction, the number of the nozzles that can eject ink at the time of the dot forming process is different for each of the plurality of the printing modes, the printing mode with a small number of the nozzles that can eject ink at the time of the dot forming process is selected, when the number of the dots in the certain region is large, the printing mode with a large number of the nozzles that can eject ink at the time of the dot forming process is selected, when the number of the dots in the certain region is small, in the printing mode with a smaller number of the nozzles that can eject ink at the time of the dot forming process, a ratio of the number of the dot rows formed using a large number of the nozzles to the number of the dot rows formed using a small number of the nozzles becomes smaller, in the printing mode with a larger number of the nozzles that can eject ink at the time of the dot forming process, a ratio of the number of the dot rows formed using a large number of the nozzles to the number of the dot rows formed using a small number of the nozzles becomes larger, and the ink is pigment ink.

12. A printing system comprising:

a carrying unit for carrying a medium in a carrying direction;

a carriage for moving each nozzle of a plurality of nozzles arranged in the carrying direction; and a controller that causes printing of an image to be printed on a medium by causing a printing apparatus to alternately repeat a dot forming process for forming dots on the medium by ejecting ink from each of the nozzles moving in a movement direction with the carriage, and a carrying process for carrying the medium in the carrying direction, and causing the printing apparatus to form a plurality of rows of dots, lined up in the carrying direction, that are configured by a plurality of dots lined up in the movement direction, the controller that causes printing with a printing mode with a predetermined ratio of a ratio of the number of the dot rows formed using a different number of the nozzles to the number of the dot rows formed using a certain number of nozzles, the different number of nozzles being larger than the certain number of nozzles, wherein the controller can select a plurality of the printing modes each with a different ratio;

wherein the controller counts a number of dots to be formed in a certain region of the medium;

wherein the controller determines the printing mode at the time of printing the certain region, according to the number of the dots formed;

wherein the printing modes comprise a first printing mode and a second printing mode, the first printing mode has a first ratio as the different ratio of the number of dot rows and the second printing mode has a second ratio as the different ratio of the number of dot rows, the second ratio being larger than the first ratio, wherein if the number of the dots to be formed in the certain region is larger than a threshold, the controller selects the first printing mode, and wherein if the number of the dots to be formed in the certain region is smaller than the threshold, the controller selects the second printing mode.

13. A storage medium recorded with a driver for making a printer perform:

a function for printing an image to be printed on a medium by repeating alternately a dot forming process for forming dots on the medium by ejecting ink from each nozzle of a plurality of nozzles, and a carrying process for carrying the medium in a carrying direction, and forming a plurality of rows of dots, lined up in the carrying direction, that are configured by a plurality of dots lined up in a movement direction;

a function for counting a number of dots to be formed in a certain region of the medium;

a function for selecting a printing mode according to the number of the dots, from among a plurality of the printing modes, each with a different ratio of the number of dot rows formed using a different number of nozzles to the number of dot rows formed using a certain number of nozzles; the different number of nozzles being larger than the certain number of nozzles; and a function for printing on the certain region to be printed, based on the selected printing mode, wherein the printing modes comprise a first printing mode and a second printing mode, the first printing mode has a first ratio as the different ratio of the number of dot rows, and the second printing mode has a second ratio as the different ratio of the number of dot rows, the second ratio being larger than the first ratio, wherein if the number of the dots to be formed in the certain region is larger than a threshold, the printer performs a function for selecting the first printing mode, and wherein if the number of the dots to be formed in the certain region is smaller than the threshold, the printer performs a function for selecting the second printing mode.

* * * * *